US010717308B2

(12) United States Patent
Suzuki

(10) Patent No.: US 10,717,308 B2
(45) Date of Patent: Jul. 21, 2020

(54) TRAY LOCKING MECHANISM, EXPANSION DEVICE PROVIDED WITH TRAY LOCKING MECHANISM, AND SHAPING SYSTEM

(71) Applicant: Casio Computer Co., Ltd., Shibuya-ku, Tokyo (JP)

(72) Inventor: Masakazu Suzuki, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 16/351,221

(22) Filed: Mar. 12, 2019

(65) Prior Publication Data

US 2019/0291486 A1 Sep. 26, 2019

(30) Foreign Application Priority Data

Mar. 26, 2018 (JP) ..... 2018-058878

(51) Int. Cl.
*B41J 29/13* (2006.01)
*B41J 13/10* (2006.01)
(Continued)

(52) U.S. Cl.
CPC ..... *B41J 29/13* (2013.01); *A47B 88/40* (2017.01); *B41J 2/16508* (2013.01); *B41J 2/44* (2013.01); *B41J 13/10* (2013.01)

(58) Field of Classification Search
CPC .... B65H 1/04; B65H 1/266; B65H 2402/155; B65H 2402/64; B65H 2405/121;
(Continued)

(56) References Cited

U.S. PATENT DOCUMENTS 5,145,160 A * 9/1992 Nagashima ..... B65H 1/04 271/117
5,419,544 A * 5/1995 Ono ..... B65H 1/04 271/157
(Continued)

FOREIGN PATENT DOCUMENTS

JP 64-28660 A 1/1989
JP 2-198883 A 8/1990
(Continued)

OTHER PUBLICATIONS

Japanese Office Action, dated Mar. 3, 2020, for Japanese Application No. 2018-058878, 4 pages. (with English translation).

*Primary Examiner* — Anh T Vo
(74) *Attorney, Agent, or Firm* — Seed IP Law Group LLP

(57) ABSTRACT

A tray locking mechanism includes a tray on which a sheet is disposed, a moving head that processes the sheet that is disposed on the tray as the moving head moves along the sheet, a tray locker that locks the movement of the tray, and a housing that houses the tray and includes a retainer. The tray locker includes a retaining claw that locks the movement of the tray by locking to the retainer. While the moving head is positioned at a position away from a stand-by position, the retaining claw is locked to the retainer as a result of the moving head separating from the tray locker, and while the moving head is positioned at the stand-by position, the retaining claw is disengaged from the retainer as a result of the moving head pushing the tray locker.

17 Claims, 23 Drawing Sheets

(51) Int. Cl.

| | |
|---|---|
| ***B41J 2/44*** | (2006.01) |
| ***A47B 88/40*** | (2017.01) |
| ***B41J 2/165*** | (2006.01) |

(58) Field of Classification Search

CPC . B41J 2/01; B41J 2/16508; B41J 13/10; B41J 29/02; B41J 29/13; B41J 29/377; B41J 2/44; A47B 88/40

See application file for complete search history.

(56) References Cited

U.S. PATENT DOCUMENTS

| | | | | | |
|---|---|---|---|---|---|
| 5,944,307 | A * | 8/1999 | Yim | ..... | B65H 1/04 271/167 |
| 2006/0237894 | A1* | 10/2006 | Nagasaki | ..... | B65B 5/067 271/10.01 |

FOREIGN PATENT DOCUMENTS

| | | | | | |
|---|---|---|---|---|---|
| JP | 7-97074 | A | | 4/1995 | |
| JP | 10-194478 | A | | 7/1998 | |
| JP | 2001-130194 | A | | 5/2001 | |
| JP | 2001-150812 | A | | 6/2001 | |
| JP | 2004-196526 | A | | 7/2004 | |
| JP | 2008-62612 | | * | 3/2008 | ..... B65H 1/26 |
| JP | 2013-177247 | A | | 9/2013 | |
| JP | 2016-179679 | A | | 10/2016 | |
| JP | 2017-158928 | A | | 9/2017 | |

* cited by examiner

PRINT HEAT CONVERSION LAYER ON FRONT SIDE

IRRADIATE FRONT SIDE WITH ELECTROMAGNETIC WAVES

PRINT COLOR INK LAYER ON FRONT SIDE

PRINT HEAT CONVERSION LAYER ON BACK SIDE

IRRADIATE BACK SIDE WITH ELECTROMAGNETIC WAVES

TRAY LOCKING MECHANISM, EXPANSION DEVICE PROVIDED WITH TRAY LOCKING MECHANISM, AND SHAPING SYSTEM

CROSS-REFERENCE TO RELATED APPLICATION

This application claims the benefit of Japanese Patent Application No. 2018-058878, filed on Mar. 26, 2018, the entire disclosure of which is incorporated by reference herein.

BACKGROUND

Technical Field

This application relates generally to a tray locking mechanism, an expansion device provided with the tray locking mechanism, and a shaping system.

Description of the Related Art

In the related art, techniques are known for forming shaped objects (also referred to as three-dimensional objects). For example, Unexamined Japanese Patent Application Kokai Publication No. 2001-130194 (Patent Literature 1) describes a forming method for a shaped object, namely an image that extends in three-dimensions. Specifically, in the method described in Patent Literature 1, heating means heats a thermally expandable sheet by irradiating the thermally expandable sheet with light based on the foaming control data. As a result of the heating, the portion of the thermally expandable sheet that is heated distends and rises, thus forming a shaped object.

In addition to the thermally expandable sheet described in Patent Literature 1, in mechanisms that use a moving head to process a sheet that is disposed on a tray, in order to stably process the sheet, the movement of the tray must be locked when processing using the moving head.

In light of such a problem, an objective of the present disclosure is to provide a tray locking mechanism capable of locking the movement of a tray using a simple structure, an expansion device provided with the tray locking mechanism, and a shaping system.

BRIEF SUMMARY

A tray locking mechanism according to a first aspect of the present disclosure that achieves the objective described above includes:

a tray on which a sheet is disposed;

a moving head that processes the sheet that is disposed on the tray as the moving head moves along the sheet;

a tray locker that locks movement of the tray; and a housing that houses the tray and includes a retainer, wherein the tray locker includes a retaining claw that locks the movement of the tray by locking to the retainer, while the moving head is positioned at a position away from a stand-by position, the retaining claw is locked to the retainer as a result of the moving head separating from the tray locker, and while the moving head is positioned at the stand-by position, the retaining claw is disengaged from the retainer as a result of the moving head pushing the tray locker.

A tray locking mechanism according to a second aspect of the present disclosure includes:

a tray on which a sheet is disposed;

a moving head that processes the sheet that is disposed on the tray as the moving head moves along the sheet; and a tray locker that locks movement of the tray, wherein the tray locker includes a retaining claw that locks the movement of the tray by locking to a retainer provided on the tray, while the moving head is positioned at a position away from a stand-by position, the retaining claw is locked to the retainer as a result of the moving head separating from the tray locker, and while the moving head is positioned at the stand-by position, the retaining claw is disengaged from the retainer as a result of the moving head pushing the tray locker.

According to the present disclosure, the movement of the tray can be locked by a simple structure.

BRIEF DESCRIPTION OF THE SEVERAL VIEWS OF THE DRAWINGS

A more complete understanding of this application can be obtained when the following detailed description is considered in conjunction with the following drawings, in which.

DETAILED DESCRIPTION

Figure 1:
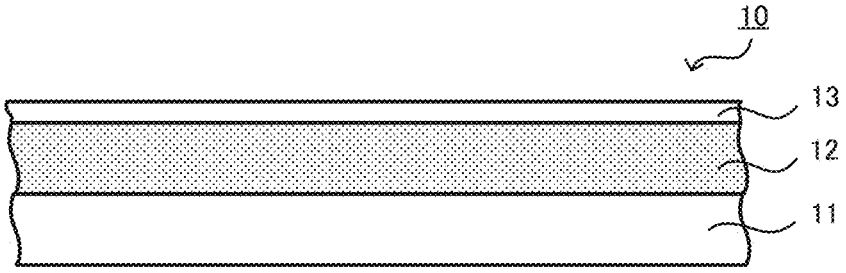
FIG. 1 is a cross-sectional view of a thermally expandable sheet according to an embodiment of the present disclosure.

Hereinafter, embodiments of the present disclosure are described while referencing the drawings. Note that, in the drawings, identical or corresponding components are marked with the same reference numerals.

In this embodiment, a shaped object is expressed on the front side of a thermally expandable sheet 10 by the bulging of a thermally expansive layer 12. In this application, the term "shaped object" includes a wide range of shapes such as simple shapes, geometrical shapes, characters, and decorations. The term "decorations" refers to objects that appeal to the aesthetic sense through visual and/or tactile sensation. The term "shaped (or molded)" does not simply refer to the forming of a shaped object, but should be construed to also include concepts such as decorating and ornamenting. The term "decorative shaped object" refers to a shaped object formed as a result of decorating or ornamenting.

The shaped object according to the present embodiment includes unevenness in a direction perpendicular (for example, the Z-axis direction) to a particular two-dimensional plane (for example, the XY plane) within three-dimensional space as a reference. This shaped object is an example of a three-dimensional (3D) image, but to distinguish this shaped object from a three-dimensional image produced using a so-called 3D printing technique, the shaped object is called a 2.5-dimensional (2.5D) image or a pseudo-three-dimensional (Pseudo-3D) image. Furthermore, the technique for producing this shaped object is an example of a three-dimensional image printing technique, but to distinguish this technique from a so-called 3D printer, the technique is called a 2.5-dimensional (2.5D) printing technique or a pseudo-three-dimensional (Pseudo-3D) printing technique.

Thermally Expandable Sheet 10

FIG. 1 illustrates the cross-sectional structure of a thermally expandable sheet (sheet) 10 according to Embodiment 1. The sheet 10 is for forming a shaped object. The thermally expandable sheet 10 is a medium in which a pre-selected portion is heated and thereby distended to form the shaped object. In the present embodiment, the shaped object is formed as a result of portions of the sheet 10 distending in a direction perpendicular to the sheet 10.

As illustrated in FIG. 1, the thermally expandable sheet 10 includes, in this order, a base 11, a thermally expansive layer 12, and an ink receiving layer 13. Note that FIG. 1 illustrates a cross-section of the thermally expandable sheet 10 in a state prior to the shaped object being formed or, in other words, in a state where the thermally expandable sheet 10 is not distended.

The base 11 is a sheet-like medium that serves as the foundation of the thermally expandable sheet 10. The base 11 is a support body that supports the thermally expansive layer 12 and the ink receiving layer 13. The base 11 is responsible for maintaining the strength of the thermally expandable sheet 10. In one example, common printer paper is used as the base 11. The material of the base 11 is not particularly limited and examples thereof include synthetic paper, canvas fabric, and plastic films such as polypropylene, polyethylene terephthalate (PET), and polybutylene terephthalate (PBT).

The thermally expansive layer 12 is laminated on the top side of the base 11, and distends as a result of being heated to a certain temperature or higher. The thermally expansive layer 12 includes a binder and a thermally expandable material dispersed in the binder. The binder is a thermoplastic resin such as ethylene-vinyl-acetate polymer or acrylic polymer. Specifically, the thermally expandable material comprises thermally expandable microcapsules (micropowder) having a particle size of about 5 to 50 μm. These microcapsules are formed by encapsulating, in a thermoplastic resin shell, a substance that vaporizes at a low boiling point such as propane or butane. When the thermally expandable material is heated to from about 80° C. to about 120° C., for example, the encapsulated substance vaporizes, and the resulting pressure causes the thermally expandable material to foam and distend. Thus, the thermally expansive layer 12 distends according to the amount of heat absorbed. The thermally expandable material is also called a foaming agent.

The ink receiving layer 13 is a layer that is laminated on the top side of the thermally expansive layer 12 and that absorbs and receives ink. The ink receiving layer 13 receives printer ink used in ink jet printers, printer toner used in laser printers, inks of ballpoint pens, fountain pens, and the like, graphite of pencils, and the like. The ink receiving layer 13 is formed from a material suitable for holding these inks and the like on the surface of the ink receiving layer 103. A material typically used for ink jet paper, for example, can be used as the material of the ink receiving layer 13.

Figure 2:
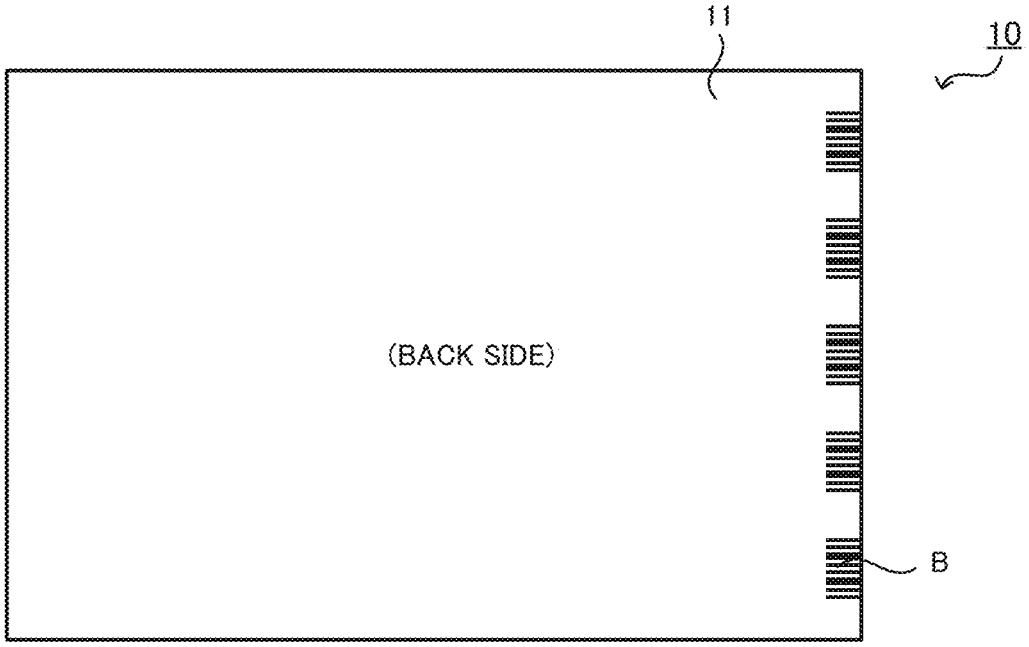
FIG. 2 is a drawing illustrating the back side of the thermally expandable sheet illustrated in FIG. 1.

FIG. 2 illustrates the back side of the thermally expandable sheet 10. The back side of the thermally expandable sheet 10 is the surface of the thermally expandable sheet 10 on the base 11 side. The back side of the thermally expandable sheet 10 corresponds to the back side of the base 11.

As illustrated in FIG. 2, a plurality of barcodes B are affixed along the edge of the back side of the thermally expandable sheet 10. The barcodes B are identifiers for identifying the thermally expandable sheet 10, and indicate that the thermally expandable sheet 10 is a dedicated sheet for forming the shaped object. The barcodes B are read by an expansion device 50 and are used to determine whether the thermally expandable sheet 10 can be used.

A shaping system 1 forms the shaped object on the thermally expandable sheet 10. Carbon molecules are printed on a portion, of the front side or the back side of the thermally expandable sheet 10, that is to be caused to distend. The carbon particles are included in a black (carbon black) ink or an ink of another color, and are a type of electromagnetic wave heat conversion material (exothermic agent) that absorbs and converts electromagnetic waves to heat. The carbon molecules absorb electromagnetic waves and thermally vibrate, thereby generating heat. When the portion of the thermally expandable sheet 10 where the carbon molecules are printed is heated, the thermally expansive layer 12 of the heated portion distends and bumps are formed in the heated portion. A protruding or uneven shape is formed by the bumps of the thermally expansive layer 12 and, as a result, the shaped object is formed in the thermally expandable sheet 10.

In the thermally expandable sheet 10, a variety of shaped objects can be obtained by combining the locations where and the heights to which the thermally expansive layer 12 is caused to distend. Additionally, a greater variety of shaped objects can be obtained by subjecting the thermally expandable sheet 10 to color printing.

Shaping System 1

Figure 3:
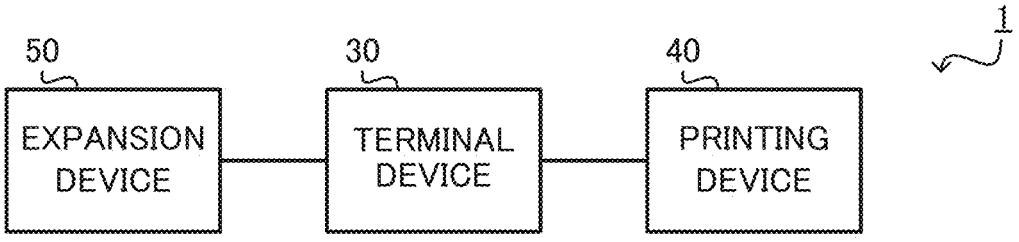
FIG. 3 is a drawing illustrating a schematic configuration of a shaping system according to an embodiment of the present disclosure.

Next, while referencing FIG. 3, a description will be given of the shaping system 1 that forms the shaped object on the thermally expandable sheet 10. As illustrated in FIG. 3, the shaping system 1 includes a terminal device 30, a printing device 40, and an expansion device 50.

Figure 4:
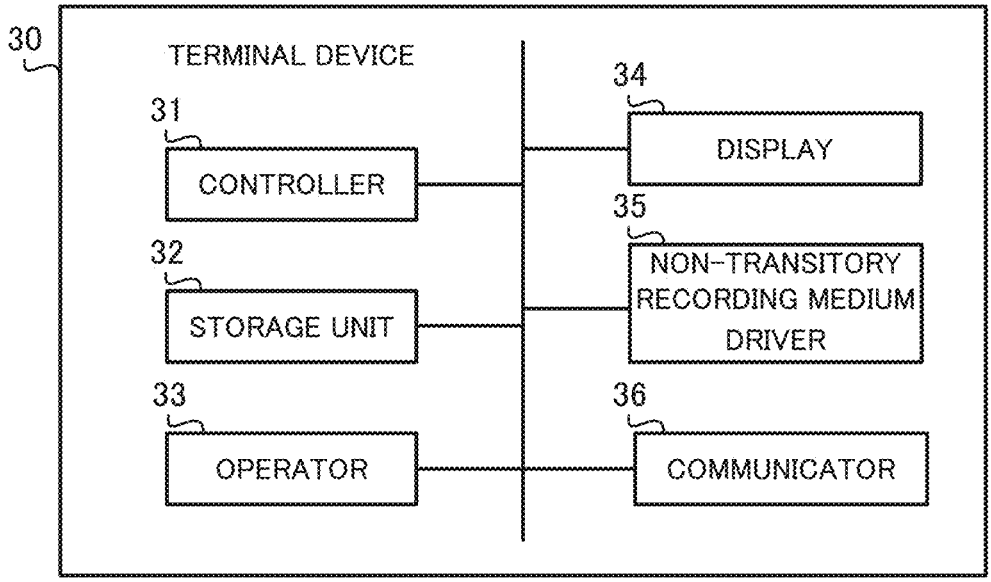
FIG. 4 is a block diagram illustrating the configuration of a terminal device according to an embodiment of the present disclosure.

The terminal device 30 is an information processing device such as a personal computer, a smartphone, or a tablet. The terminal device 30 is a control unit that controls the printing device 40 and the expansion device 50. As illustrated in FIG. 4, the terminal device 30 includes a controller 31, a storage unit 32, an operator 33, a display 34, a non-transitory recording medium driver 35, and a communicator 36. Each of these components is connected to a bus for transmitting signals.

The controller 31 includes a central processing unit (CPU), read only memory (ROM), and random access memory (RAM). In the controller 31, the CPU reads a control program stored in the ROM and controls the operations of the entire terminal device 30 while using the RAM as working memory.

The storage unit 32 is nonvolatile memory such as flash memory or a hard disk. Data and programs to be executed by the controller 31 are stored in the storage unit 32. Additionally, data of color images to be printed by the printing device 40, front side foaming data, and back side foaming data are stored in the storage unit 32.

The operator 33 includes an input device such as a keyboard, a mouse, buttons, a touch pad, and a touch panel. The operator 33 receives operations from the user. By operating the operator 33, the user can input operations for editing the color image data, the front side foaming data, or the back side foaming data; operations for the printing device 40 or the expansion device 50; or the like.

The display 34 includes a display device such as a liquid crystal display or an organic electro luminescence (EL) display, and a display driving circuit that causes images to be displayed on the display device. In one example, the display 34 displays the color image data, the front side foaming data, and the back side foaming data. Additionally, as desired, the display 34 may display information indicating the state of the printing device 40 or the state of the expansion device 50.

The non-transitory recording medium driver 35 reads programs or data stored in a portable recording medium. Examples of the portable recording medium include a compact disc (CD) ROM, a digital versatile disc (DVD) ROM, and flash memory provided with a universal serial bus (USB) standard connector. In one example, the non-transitory recording medium driver 35 reads and acquires the color image data, the front side foaming data, and the back side foaming data from the portable recording medium.

The communicator 36 includes an interface for communicating with external devices, including the printing device 40 and the expansion device 50. The terminal device 30 is connected to the printing device 40 and the expansion device 50 via a wire such as a flexible cable or a wired local area network (LAN) or is wirelessly connected to the printing device 40 and the expansion device 50 via a wireless LAN, Bluetooth (registered trademark), or the like. The communicator 36 communicates with the printing device 40 and the expansion device 50 under the control of the controller 31.

Printing Device 40

The printing device 40 is a printing unit that prints images on the front side or the back side of the thermally expandable sheet 10. In one example, the printing device 40 is an ink jet printer that prints images via a method in which ink is micronized and directly sprayed on print media.

Figure 5:
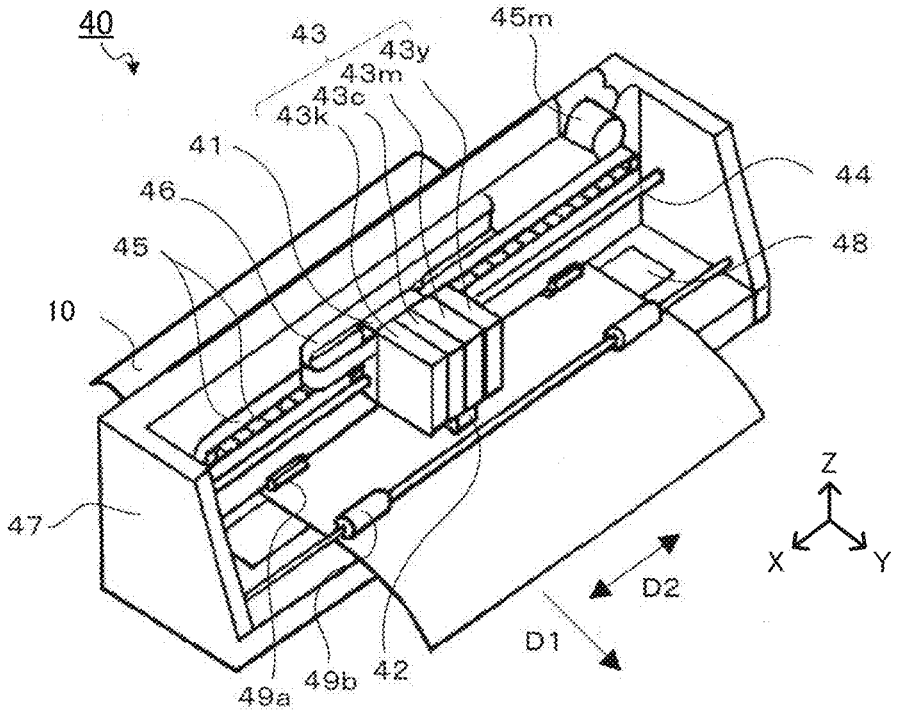
FIG. 5 is a perspective view illustrating the configuration of a printing device according to an embodiment of the present disclosure.

FIG. 5 illustrates the detailed configuration of the printing device 40. As illustrated in FIG. 5, the printing device 40 includes a carriage 41 capable of reciprocating movement in a main scanning direction D2 (the X-direction), which is orthogonal to a sub scanning direction D1 (the Y-direction). The sub scanning direction D1 is the direction in which the thermally expandable sheet 10 is transported.

A print head (moving head or head) 42 that executes the printing, and ink cartridges 43 (43*k*, 43*c*, 43*m*, and 43*y*) containing ink are attached to the carriage 41. The ink cartridges 43*k*, 43*c*, 43*m*, and 43*y* respectively contain black (K), cyan (C), magenta (M), and yellow (Y) color ink. Each color of ink is discharged from a corresponding nozzle of the print head 42.

The carriage 41 is supported slidably on a guide rail 44, and is sandwiched between drive belts 45. The drive belts 45 transmit the rotational driving force of the motor 45*m*, thereby driving the carriage 41 in the main scanning direction D2 together with the print head 42 and the ink cartridges 43.

A platen 48 is provided in a lower portion of a frame 47, at a position facing the print head 42. The platen 48 extends in the main scanning direction D2 and constitutes a portion of a transport path of the thermally expandable sheet 10. A pair of feed rollers 49*a* (lower roller not illustrated in the drawings) and a pair of discharge rollers 49*b* (lower roller not illustrated in the drawings) are provided on the transport path of the thermally expandable sheet 10. The pair of feed rollers 49*a* and the pair of discharge rollers 49*b* transport the thermally expandable sheet 10, supported by the platen 48, in the sub scanning direction D1.

The printing device 40 is connected to the terminal device 30 via a flexible communication cable 46. The terminal device 30 controls the print head 42, the motor 45*m*, the pair of feed rollers 49*a*, and the pair of discharge rollers 49*b* via the flexible communication cable 46. Specifically, the terminal device 30 controls the pair of feed rollers 49*a* and the pair of discharge rollers 49*b* to transport the thermally expandable sheet 10 to the pair of feed rollers 49*a* and the pair of discharge rollers 49*b*. Additionally, the terminal device 30 causes the motor 45*m* to rotate, which causes the carriage 41 to move. As a result, the motor 45*m* transports the print head 42 to an appropriate position in the main scanning direction D2.

The printing device 40 acquires the image data from the terminal device 30. The printing device 40 executes printing on the basis of the acquired image data. Specifically, the printing device 40 acquires the color image data, the front side foaming data, and the back side foaming data as the image data. The color image data is data that indicates the color image to be printed on the front side of the thermally expandable sheet 10. Based on the color image data, the printing device 40 causes the print head 42 to spray cyan (C), magenta (M), and yellow (Y) inks toward the thermally expandable sheet 10 to print the color image.

The front side foaming data is data that indicates the portion of the front side of the thermally expandable sheet 10 to be foamed and caused to swell. The back side foaming data is data that indicates the portion of the back side of the thermally expandable sheet 10 to be foamed and caused to swell. The printing device 40 causes the print head 42 to spray black (K) ink that contains carbon black toward the thermally expandable sheet 10 to print a gray-scale image (that is, a heat conversion layer) using this black ink. The carbon black-containing black ink is an example of an electromagnetic wave heat conversion material that converts electromagnetic waves to heat.

Expansion Device 50

The expansion device 50 is an expansion unit that causes the portion of the thermally expandable sheet 10 where the heat conversion layer is printed to distend by irradiating the front side or the back side of the thermally expandable sheet 10 with electromagnetic waves and causing the heat conversion layer printed on the front side or the back side of the thermally expandable sheet 10 to generate heat.

Figure 6:
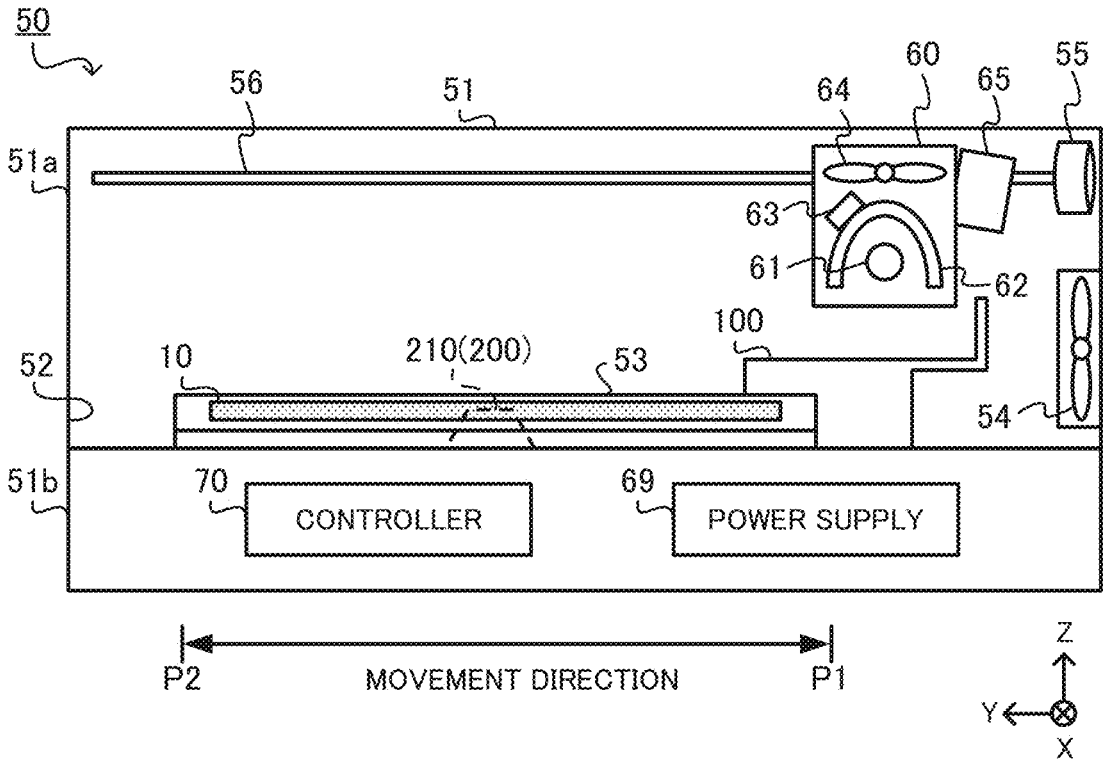
FIG. 6 is a cross-sectional view illustrating the configuration of an expansion device according to an embodiment of the present disclosure.

FIG. 6 schematically illustrates the configuration of the expansion device 50. In FIG. 6, the +X-direction (depth dimension on paper) corresponds to the width direction of the expansion device 50. The +Y-direction (left direction on paper) corresponds to the longitudinal direction of the expansion device 50. In, the +Z-direction (up dimension on paper) corresponds to the vertical direction. The +X-direction, the +Y-direction, and the +Z-direction are orthogonal to each other.

The expansion device 50 moves the irradiator 60 and causes the irradiator 60 to irradiate the thermally expandable sheet 10 that is mounted on a tray 53 with electromagnetic waves, thereby causing the thermally expandable sheet 10 to distend. The irradiator 60 moves back and forth between a first position P1 and a second position P2. The first position P1 is the initial position (stand-by position) of the irradiator 60. The irradiator 60 stands by at the first position P1 when the expansion device 50 is not operating. The first position P1 is located at a position recessed from a tray enclosure 52 (described later) and, as such, it is less likely that the hands of the user will come in contact with the irradiator 60 when replacing the thermally expandable sheet 10. The second position P2 is a reversing position where the movement direction of the irradiator 60 reverses.

The expansion device 50 includes a box-shaped housing 51. The interior of the housing 51 is partitioned into an upper housing 51*a* and a lower housing 51*b*. The temperature in the upper housing 51*a* rises due to the irradiation of the electromagnetic waves from the irradiator 60. However, the configuration described above can suppress the impact of the heat in the upper housing 51*a* on the substrates and other components in the lower housing 51*b*. The expansion device 50 includes a housing 51, a tray 53, a ventilator 54, a transportation motor 55, a transportation rail 56, an irradiator 60, a power supply 69, a controller 70, and a tray locker 100.

Figure 9:
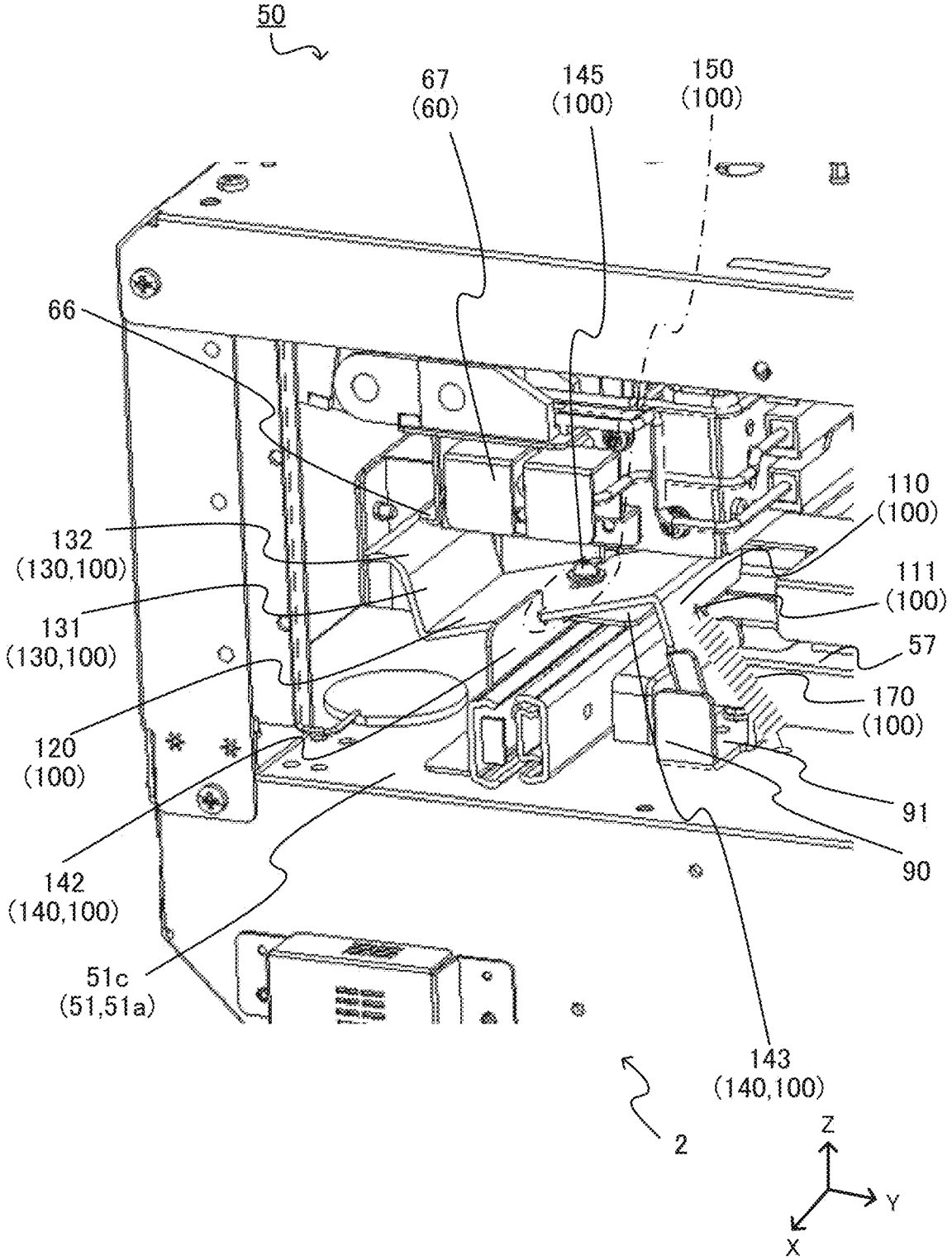
FIG. 9 is a perspective view illustrating the area around tray locking hardware of the expansion device according to an embodiment of the present disclosure.

As illustrated in FIG. 9, an attachment 90 that includes a retainer 91 is disposed at a position on the +X-direction side and the −Y-direction side of a bottom surface 51*c* of the upper housing 51*a*. When viewed on the XY plane, the retainer 91 has a rough L-shape. The retainer 91 locks a retaining claw 110 of the tray locker 100 (described later). In cases in which the retainer 91 becomes worn or damaged, there is no need to repair or replace the housing 51. Instead, it is sufficient to replace the attachment 90. As illustrated in FIG. 6, the upper housing 51*a* includes the tray enclosure 52 that is capable of moving the tray 53 in a sliding manner in the +X-direction and the −X-direction.

The tray 53 is a mechanism for setting the thermally expandable sheet 10 at an appropriate position in the housing 51. The tray 53 includes a sensor (not illustrated in the drawings) that detects the thermally expandable sheet 10. The sensor detects whether the thermally expandable sheet 10 has been arranged on the tray 53. The sensor also detects the size of the thermally expandable sheet 10. The tray 53 is attached to a pair of slide rails provided in the housing 51.

Figure 7A:
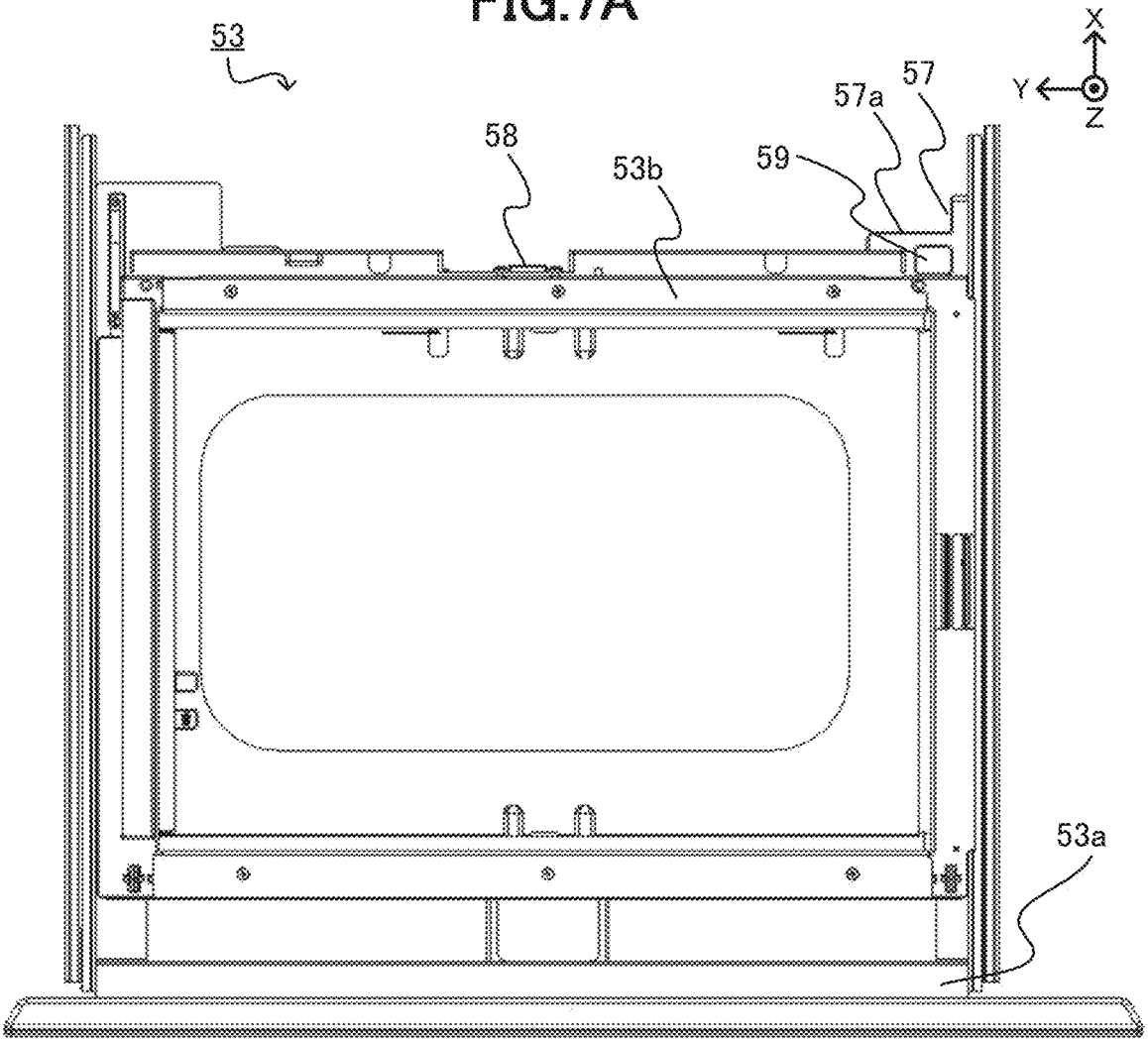
FIG. 7A is a plan view illustrating a tray according to an embodiment of the present disclosure.
Figure 7B:
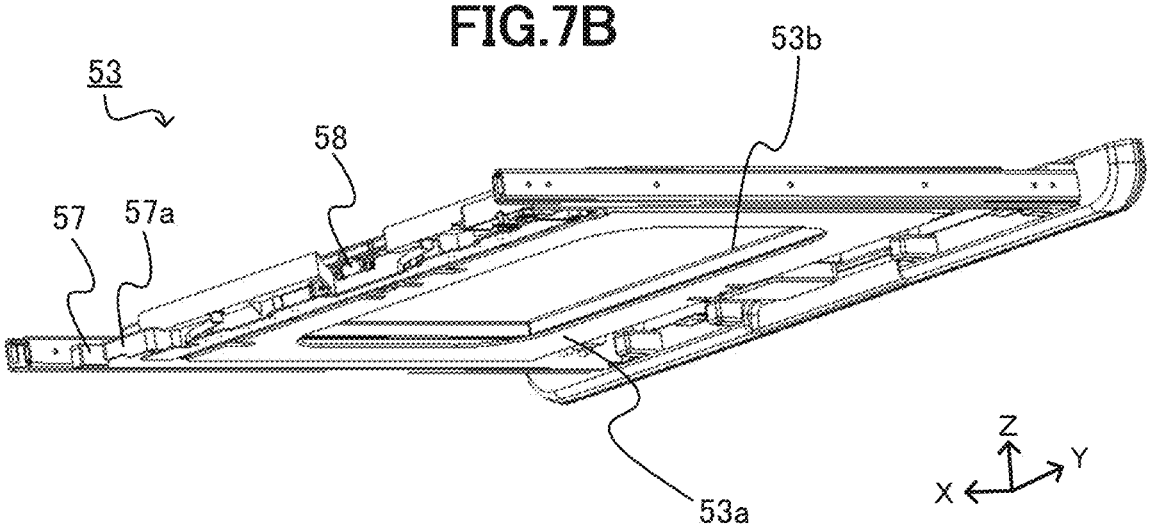
FIG. 7B is a perspective view illustrating the tray according to an embodiment of the present disclosure.
Figure 7C:
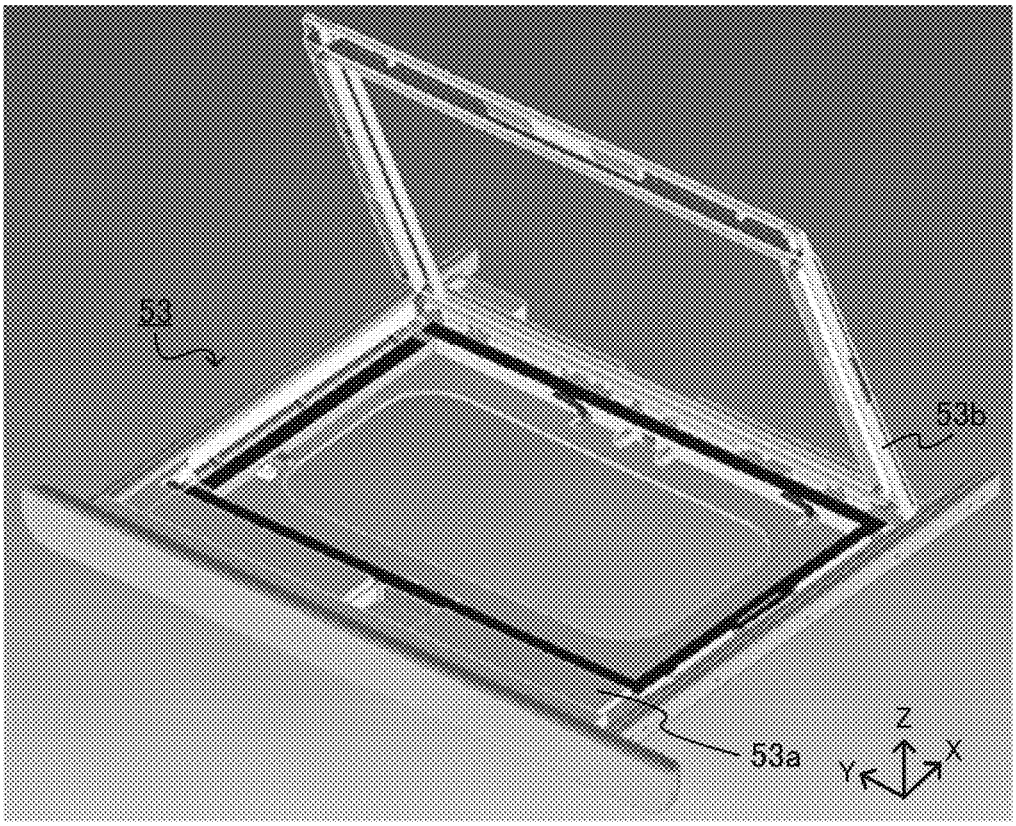
FIG. 7C is a perspective view illustrating a tray, according to an embodiment of the present disclosure, in a state where a pressing member is open.
Figure 7D:
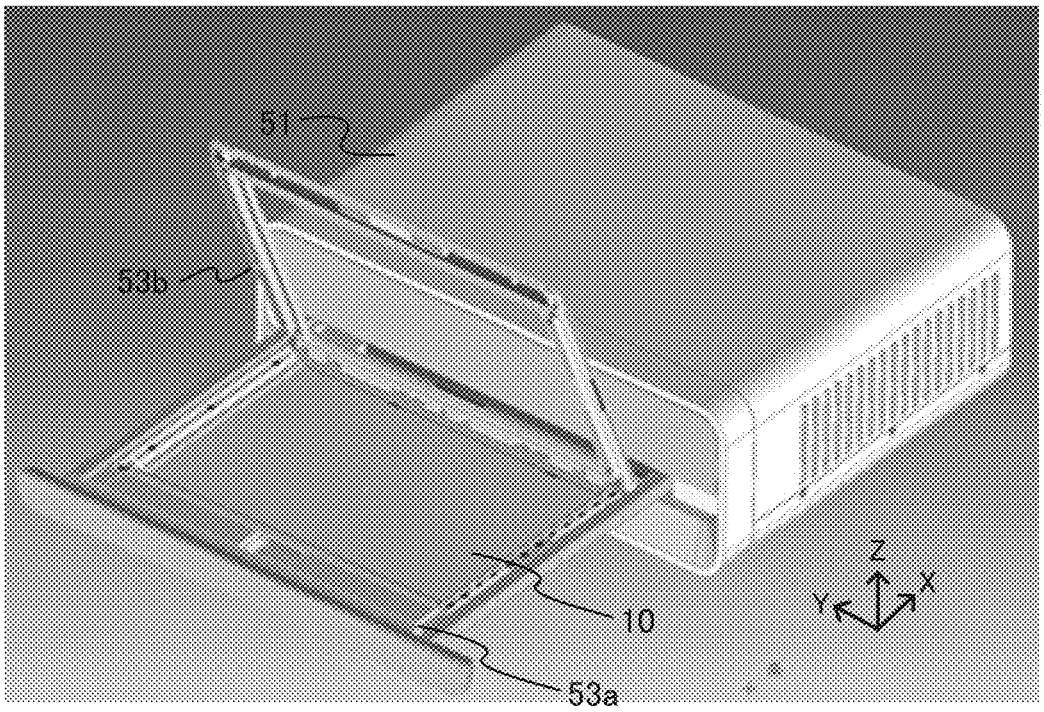
FIG. 7D is a perspective view illustrating the tray, according to an embodiment of the present disclosure, in a state where the pressing member is open and the thermally expandable sheet is mounted.
Figure 8:
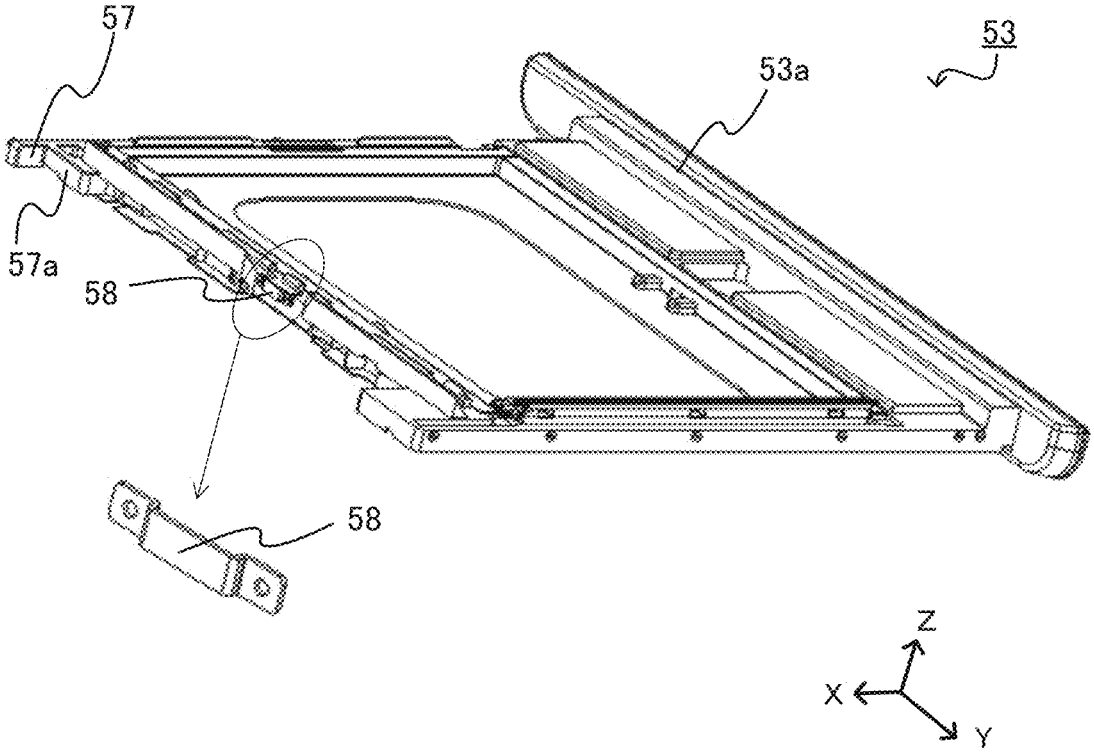
FIG. 8 is a perspective view illustrating a sheet mount and an engager of the tray according to an embodiment of the present disclosure.
Figure 10:
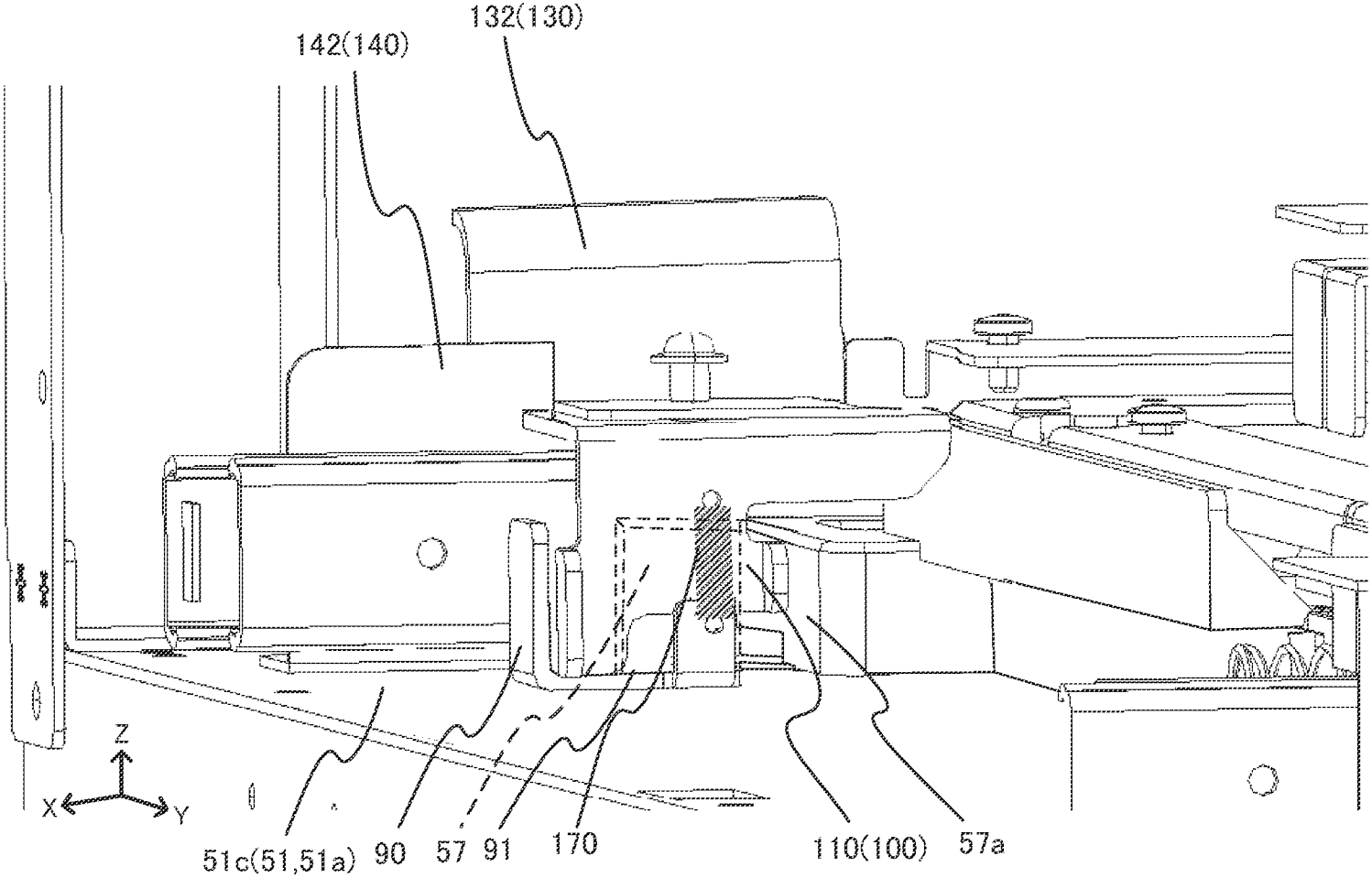
FIG. 10 is an enlarged perspective view illustrating the positional relationship between a retaining claw and a retaining claw abutment, in a state in which the tray according to an embodiment of the present disclosure is locked.

The tray 53 slides along the slide rails in the +X-direction or the −X-direction. A user pulls the tray 53 out from the housing 51 to set and remove the thermally expandable sheet 10. As illustrated in FIGS. 7A and 7B, the tray 53 includes a sheet mount 53*a* on the top surface, and a pressing member 53*b* that is disposed so as to cover the top surface of the sheet mount 53*a*. The thermally expandable sheet 10 is mounted on the sheet mount 53*a*. The pressing member 53*b* is open and closed by the user. As illustrated in FIGS. 7A, 7B, and 8, the sheet mount 53*a* is a box-shaped housing. The surface in the +Z-direction of the sheet mount 53*a* is open. The sheet mount 53*a* includes an opening in the bottom panel. Moreover, the sheet mount 53*a* includes a metal engager 58 in a middle portion of the side surface of the +X-direction side. The engager 58 engages with a push latch 200 (described later). The pressing member 53*b* holds the thermally expandable sheet 10 down, thereby fixing the thermally expandable sheet 10 on the sheet mount 53*a*. FIG. 7C illustrates the tray 53 in a state where the pressing member is open. FIG. 7D illustrates the tray 53 in a state where the pressing member 53*b* is open and the thermally expandable sheet 10 is mounted on the sheet mount 53*a*. As illustrated in FIGS. 7A and 7B, the sheet mount 53*a* includes a retaining claw abutment 57 at the end of the −Y-direction side of the side surface on the +X-direction side. The retaining claw abutment 57 is formed into a rough L-shape that includes a short edge extending in the +X-direction and a long edge extending in the +Y-direction from the end of the −X-direction side of the short edge. As illustrated in FIGS. 7A and 10, the long side of the retaining claw abutment 57 includes a side wall 57*a* that abuts against the retaining claw 110 of the tray locker 100 that is locked to the retainer 91. The +X-direction movement of the tray 53 is obstructed as a result of the side wall 57*a* of the retaining claw abutment 57 abutting against the retaining claw 110 of the tray locker 100 locked to the retainer 91. Releasing of the locking of the push latch 200 is obstructed as a result of the +X-direction movement of the tray 53 being obstructed.

Specifically, during the period when the irradiator 60 is irradiating the thermally expandable sheet 10 with the electromagnetic waves (that is, during the period in which the irradiator 60 is positioned at a position away from the first position P1), the engager 58 of the sheet mount 53*a* engages with the push latch 200, thereby locking the tray 53 and preventing sliding movement.

When the irradiator 60 is standing by at the first position P1, the locking against the +X-direction movement of the tray 53 is released. At this time, the locking of the push latch 200 is released as a result of the user pushing the tray 53 a predetermined distance in the +X-direction. Since the locking of the push latch is released, the user can slide-move the tray 53 in the −X-direction (the direction of pulling the tray 53 out from the housing 51).

As illustrated in FIG. 6, a ventilator 54 is provided at the end of the −Y-direction side of the expansion device 50. The ventilator 54 ventilates the interior of the expansion device 50. The ventilator 54 includes at least one fan. The ventilator 54 ventilates the interior of the housing 51 by exhausting the air in the housing 51 out of the housing 51.

In one example, the transportation motor 55 is a stepping motor that operates in synchronization with pulsed power. The transportation motor 55 moves the irradiator 60 along the front side or the back side of the thermally expandable sheet 10. A transportation rail 56 extending in the +Y-direction is provided in the housing 51. The irradiator 60 is attached to the transportation rail 56 and moves along the transportation rail 56. The irradiator 60 uses the transportation motor 55 as a power source to move back and forth along the transportation rail 56 while maintaining a certain distance from the thermally expandable sheet 10. The transportation motor 55 functions as a moving device that moves the thermally expandable sheet 10 and the irradiator 60 relative to each other.

Specifically, the irradiator 60 moves back and forth between the first position P1 and the second position P2 that respectively correspond to the end of the −Y-direction side and the end of the +Y-direction side of the thermally expandable sheet 10. The transportation motor 55 moves the irradiator 60 in a first direction from the first position P1 toward the second position P2, and in a second direction from the second position P2 toward the first position P1. The first position P1 is the initial position (home position) of the irradiator 60. The irradiator 60 stands by at the first position P1 when the expansion device 50 is not operating.

Figure 12A:
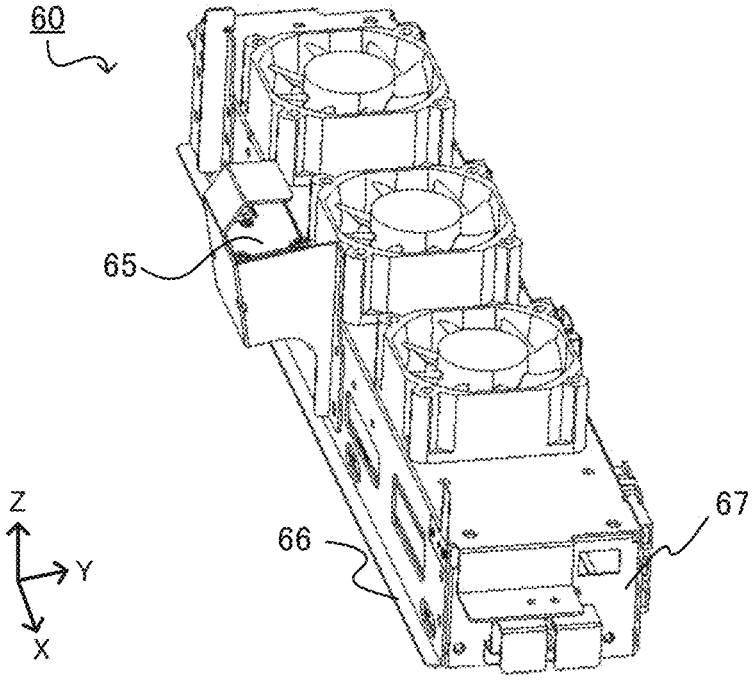
FIG. 12A is a perspective view illustrating an irradiator according to an embodiment of the present disclosure.
Figure 12B:
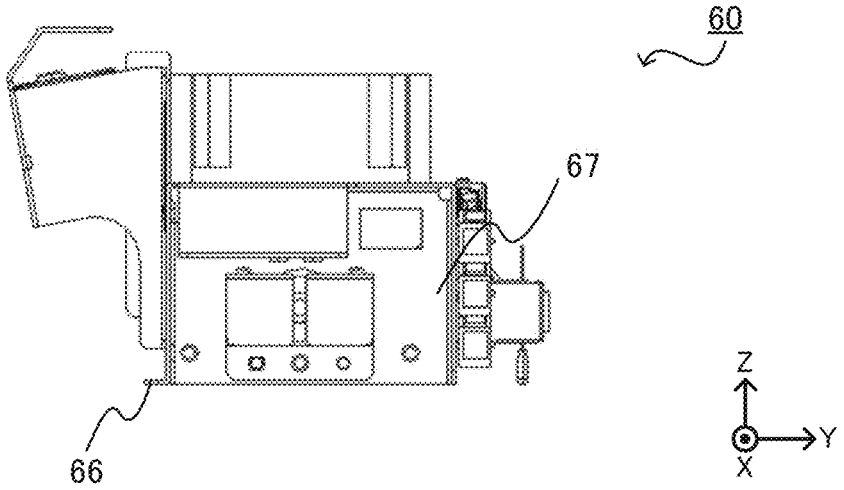
FIG. 12B is a front view illustrating the irradiator according to an embodiment of the present disclosure.

The moving head, namely the irradiator 60, is a mechanism that processes (expansion processes) the thermally expandable sheet 10 by irradiating electromagnetic waves toward the thermally expandable sheet 10 while moving in a direction that crosses the direction in which the tray 53 is inserted and pulled out. A predetermined gap is provided between the irradiator 60 and the thermally expandable sheet 10 that is arranged on the tray 53. As illustrated in FIG. 6, the irradiator 60 includes, inside a box-like cover 67, a lamp heater 61, a reflection plate 62, a temperature sensor 63, and a cooler 64. Moreover, as illustrated in FIGS. 12A and 12B, the irradiator 60 includes a pusher 66 at one end of the cover 67.

In one example, the lamp heater 61 includes a halogen lamp as an irradiation source. The lamp heater 61 emits light in the near-infrared region (750 to 1400 nm wavelength range), the visible light spectrum (380 to 750 nm wavelength range), or the intermediate infrared region (1400 to 4000 nm wavelength range) toward the thermally expandable sheet 10. The irradiator 60 and the lamp heater 61 function as irradiating devices that irradiate the thermally expandable sheet 10 with light (that is, energy).

When the thermally expandable sheet 10 that includes the heat conversion layer made from carbon black-containing black ink is irradiated with light of a predetermined wavelength range, the portions of the thermally expandable sheet 10 where the heat conversion layer is provided convert the light to heat more efficiently than the other portions of the thermally expandable sheet 10. Accordingly, the portions of the thermally expandable sheet 10 where the heat conversion layer is provided are selectively heated. When the portions of the thermally expandable sheet 10 where the heat conversion layer is printed are heated to greater than or equal to the temperature at which the thermally expandable material begins to expand, the thermally expansive layer 12 of the portions of the thermally expandable sheet 10 where the heat conversion layer is provided, distend. The irradiator 60 irradiates light (energy) and, as such, functions as a thermal expander that causes the thermally expandable sheet 10 to thermally expand. Note that the light emitted from the lamp heater 61 is not limited to the light of the wavelength ranges described above, and may be light of any wavelength range that can be absorbed and converted to heat by the heat conversion layer.

The reflection plate 62 is disposed so as to cover the top side of the lamp heater 61. The reflection plate 62 is a mechanism that reflects the light emitted from the lamp heater 61 toward the thermally expandable sheet 10. The temperature sensor 63 is a thermocouple, a thermistor, or the like. The temperature sensor 63 functions as a measuring device that measures the temperature of the reflection plate 62. The cooler 64 includes at least one fan. The cooler 64 cools the irradiator 60 and the interior of the housing 51.

When viewed on the YZ plane, the pusher 66 is a rectangular plate-like member that projects in the −Y-direction from the lower end of the cover 67. When the irradiator 60 is standing by at the first position P1, the pusher 66 contacts the tray locking hardware 160 of the tray locker 100 (described later), thereby pushing the tray locking hardware 160 and releasing the restriction of the +X-direction movement of the tray 53. The components of the irradiator 60 other than the pusher 66 do not abut against the tray locking hardware 160. The pusher 66 wears as a results of contacting the tray locking hardware 160 and, as such, in order to facilitate the replacement of the pusher 66, it is preferable that the pusher 66 be provided in a detachable manner.

Figure 13:
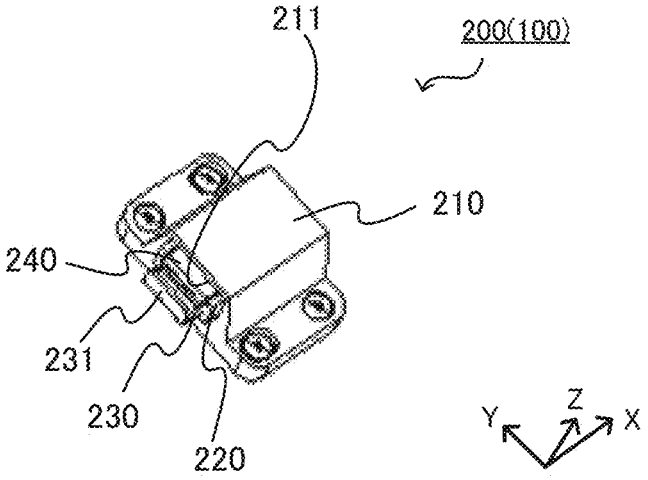
FIG. 13 is a perspective view illustrating a push latch according to an embodiment of the present disclosure.
Figure 15:
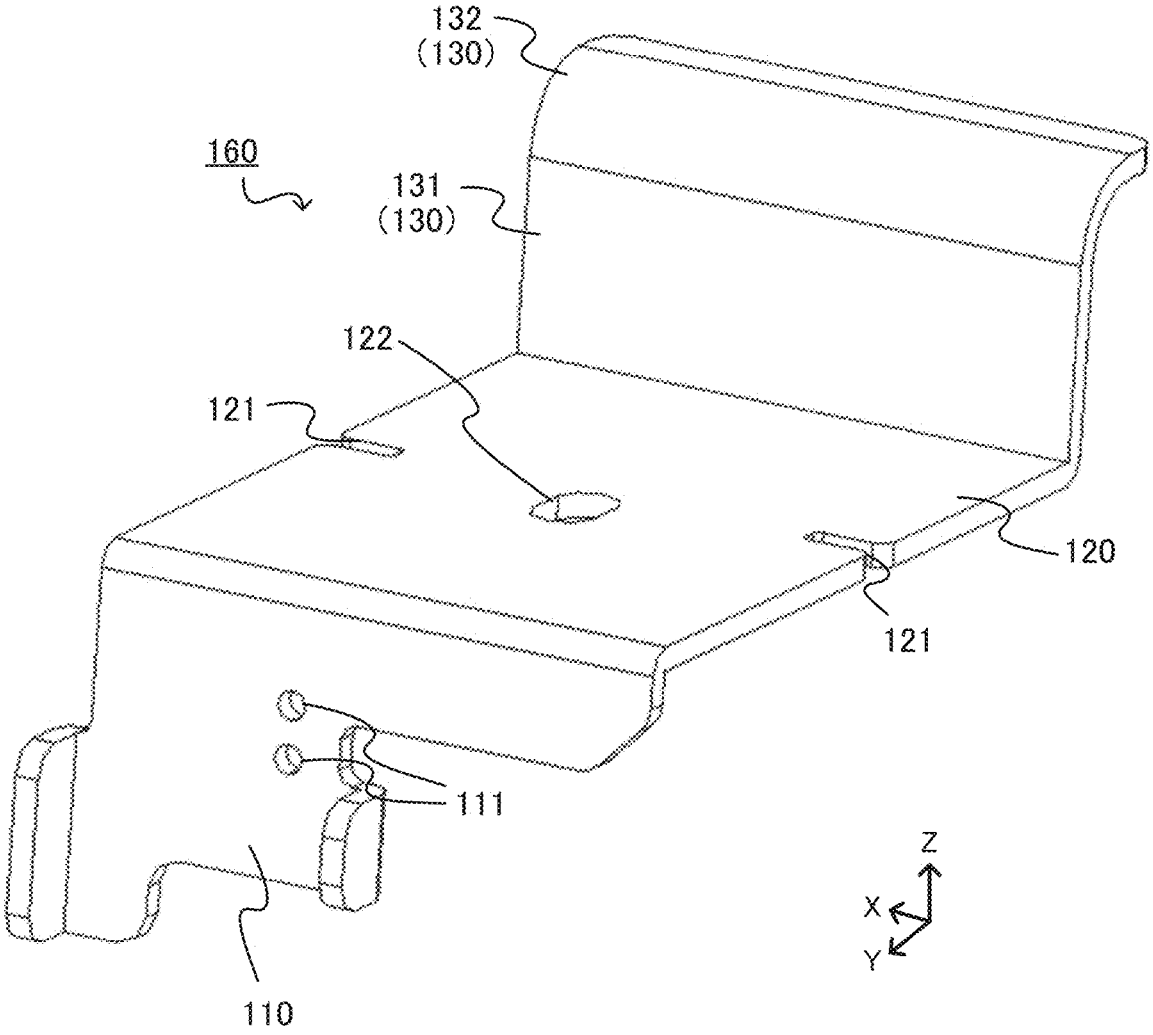
FIG. 15 is a perspective view illustrating the tray locking hardware according to an embodiment of the present disclosure.

As illustrated in FIGS. 9 and 13, a locking mechanism, namely the tray locker 100, includes the retaining claw 110, a connector 120, a lever 130, a fixer 140, a pivoter 150, and a push latch (latch) 200. In the present embodiment, the retaining claw 110, the connector 120, and the lever 130 constitute the tray locking hardware 160, as illustrated in FIG. 15. The tray locking hardware 160 is a pivoting member that has a pivot axis extending along the sliding direction of the tray 53 (the +X-direction or the −X-direction). The +Z-direction and the −Z-direction are the up-down operation directions of both ends of the tray locking hardware 160. The retaining claw 110 is provided at a first end of the tray locking hardware 160. The lever 130 is provided at a second end of the tray locking hardware 160. The tray locking hardware 160 engages with the fixer 140 such that the retaining claw 110 is positioned on the second position P2 side (the +Y-direction side) of the irradiator 60 and the lever 130 is positioned on the first position P1 side (the −Y-direction side) of the irradiator 60. In a state in which the tray 53 is inserted into the housing 51, the tray locking hardware 160 engages with the fixer 140 such that the retaining claw 110 of the tray locking hardware 160 is positioned farther to the +X-direction side than the side wall 57*a* of the tray 53. As illustrated in FIGS. 6 and 9, the tray locker 100 is disposed on the bottom surface 51*c* of the upper housing 51*a*. Specifically, the fixer 140 is attached to the bottom surface 51*c* such that the retaining claw 110 locks to the retainer 91 that is provided on the bottom surface 51*c*. Additionally, the push latch 200 is attached to the bottom surface 51*c* so as to engage with the engager 58 of the tray 53.

Figure 11:
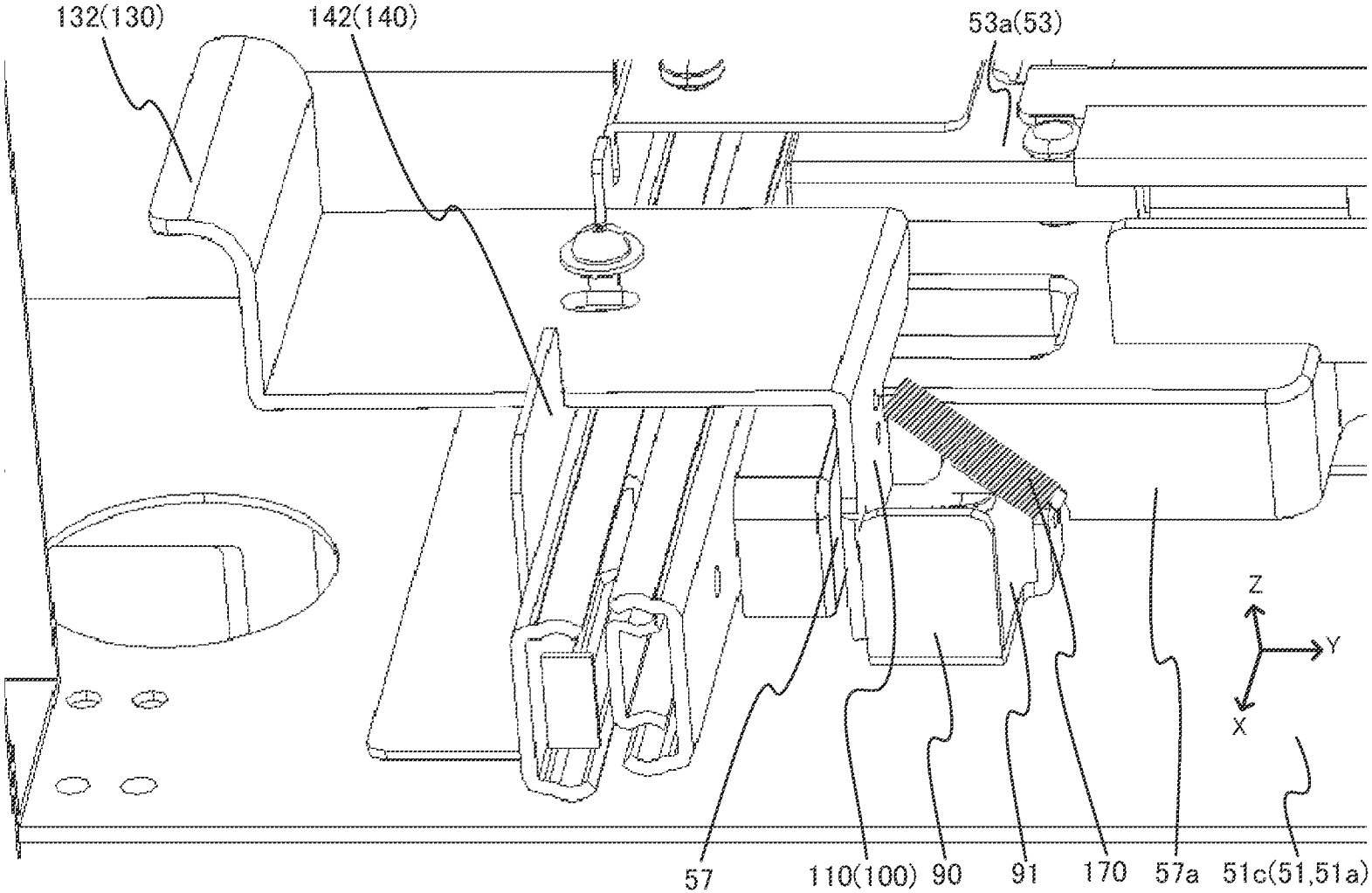
FIG. 11 is an enlarged perspective view illustrating the positional relationship between a retaining claw and a retaining claw abutment, in a state in which the tray according to an embodiment of the present disclosure is locked.

When the tray 53 is inserted into the housing 51, the engager 58 of the tray 53 engages with the push latch 200. Moreover, when the lever 130 is released by a predetermined amount of pressing force, the tray locking hardware 160 pivots and the retaining claw 110 is locked to the retainer 91 (FIGS. 10 and 11). The retaining claw 110 that is locked to the retainer 91 is positioned farther to the +X-direction side than the side wall 57*a* of the tray 53. Therefore, as illustrated in FIG. 10, the retaining claw 110 abuts against the side wall 57*a* of the retaining claw abutment 57 of the tray 53, and the +X-direction movement of the tray 53 is obstructed. As a result, the user is unable to release the locking of the +X-direction and −X-direction movement of the tray 53 by the push latch 200.

Figure 16:
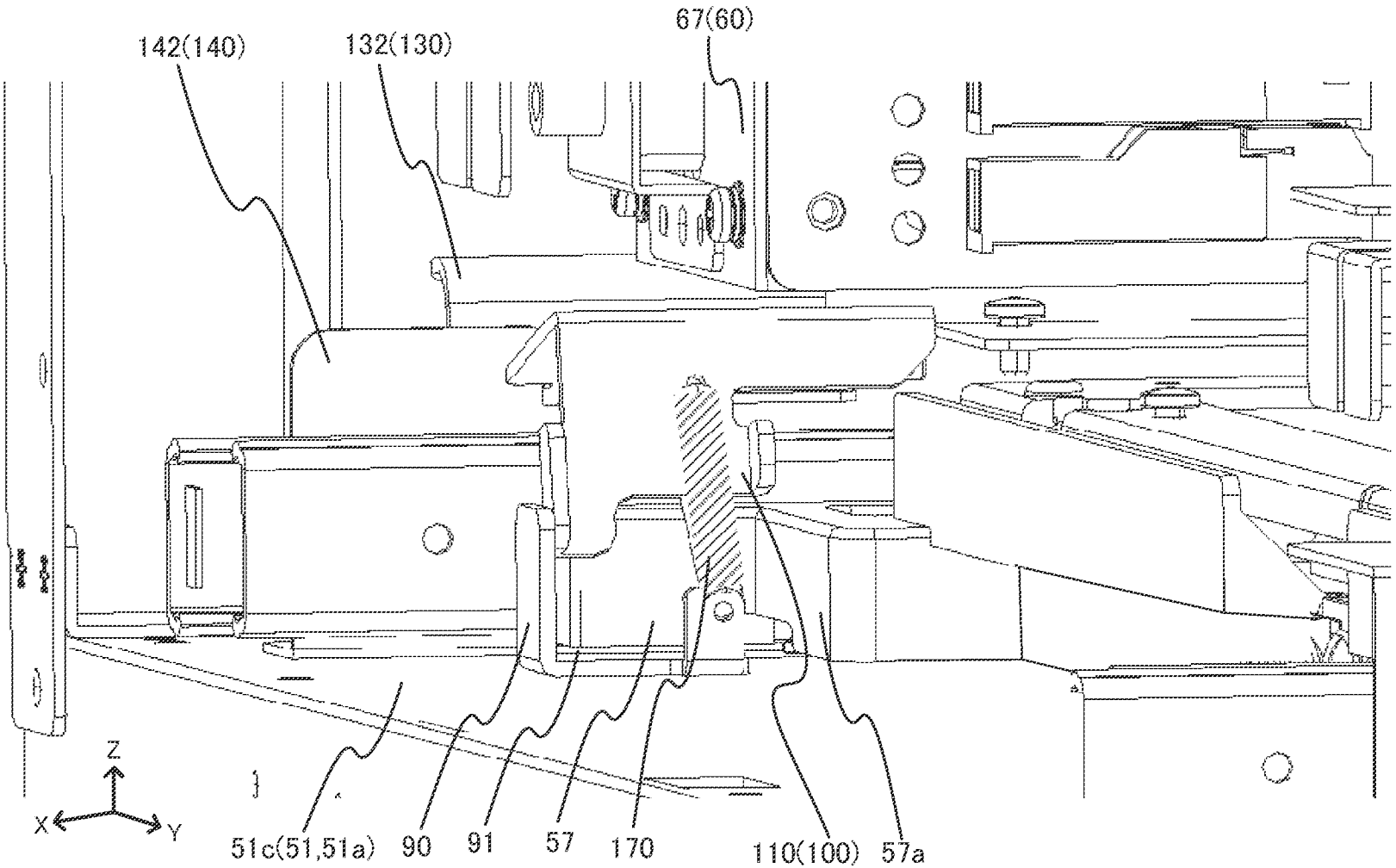
FIG. 16 is an enlarged perspective view illustrating the positional relationship between the retaining claw and the retaining claw abutment, in a state in which the locking of the tray according to an embodiment of the present disclosure is released.
Figure 17:
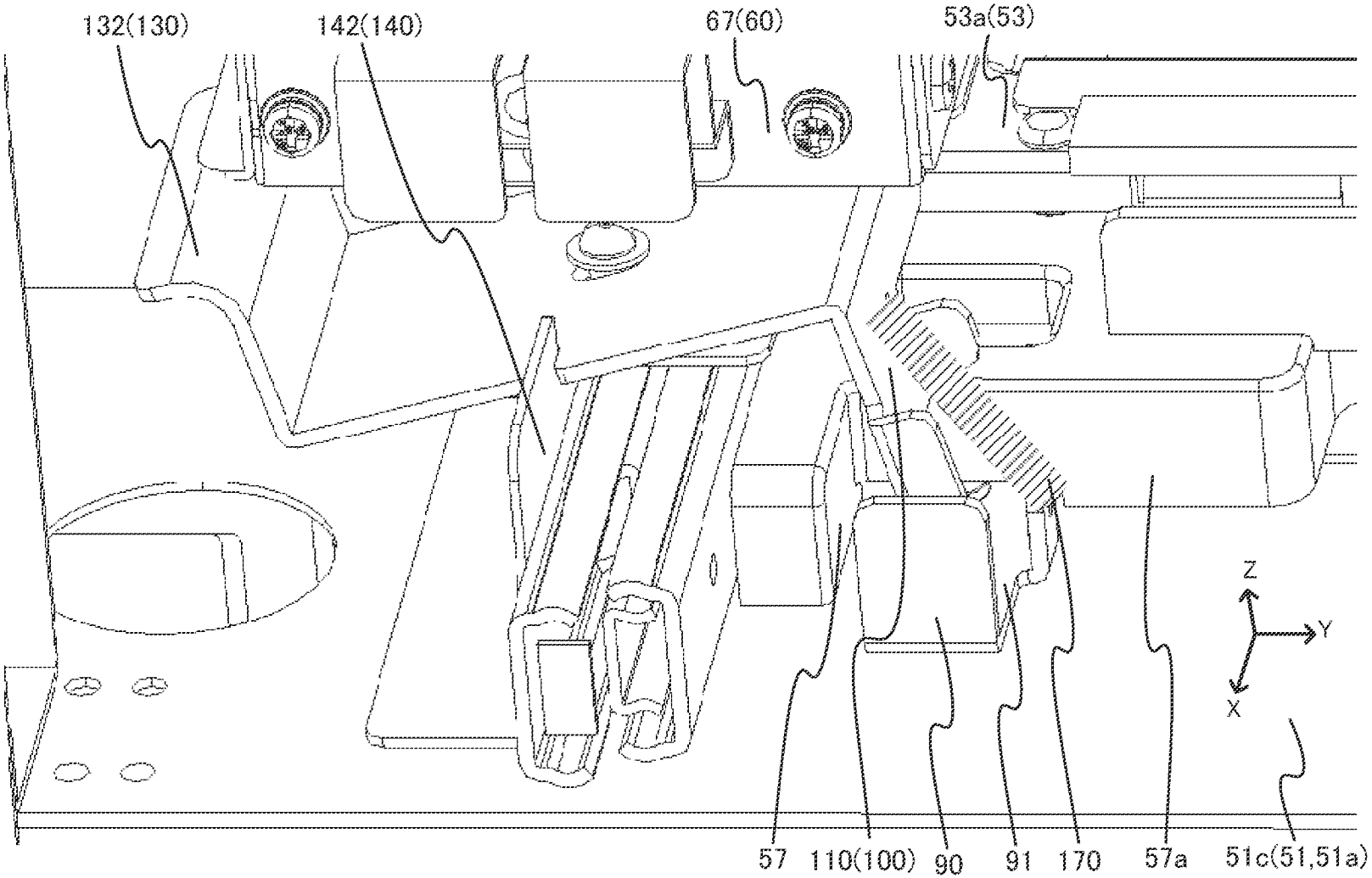
FIG. 17 is an enlarged perspective view illustrating the positional relationship between the retaining claw and the retaining claw abutment, in a state in which the locking of the tray according to an embodiment of the present disclosure is released.

When the irradiator 60 moves from the second position P2 to the first position P1, the pusher 66 of the irradiator 60 contacts the lever 130 of the tray locking hardware 160 and pushes the lever 130 with a predetermined amount of pressing force. As a result, the retaining claw 110 is disengaged from the retainer 91, as illustrated in FIGS. 16 and 17. Since the retaining claw 110 is disengaged from the retainer 91, the user can move the tray 53 in the +X-direction. Then, the user can move the tray 53 in the +X-direction and the −X-direction by sliding the tray 53 a predetermined distance in the +X-direction and releasing the engagement between the push latch 200 and the engager 58 of the tray 53. A tray locking mechanism 2 for locking the tray 53 is constituted by the housing 51, the tray 53, the irradiator 60, and the tray locker 100.

As illustrated in FIG. 16, the retaining claw 110 extends in the −Z-direction from an end of the connector 120. When the +X-direction and −X-direction movement of the tray 53 is locked, the surface of a portion of the retaining claw 110 on the −X-direction side abuts against the side wall 57*a* of the tray 53, thereby obstructing the +X-direction movement of the tray 53. The retaining claw 110 is inserted into the retainer 91 and locks to the retainer 91. The retaining claw 110 includes an attachment hole 111 for attaching an elastic member 170 (described later).

Figure 19A:
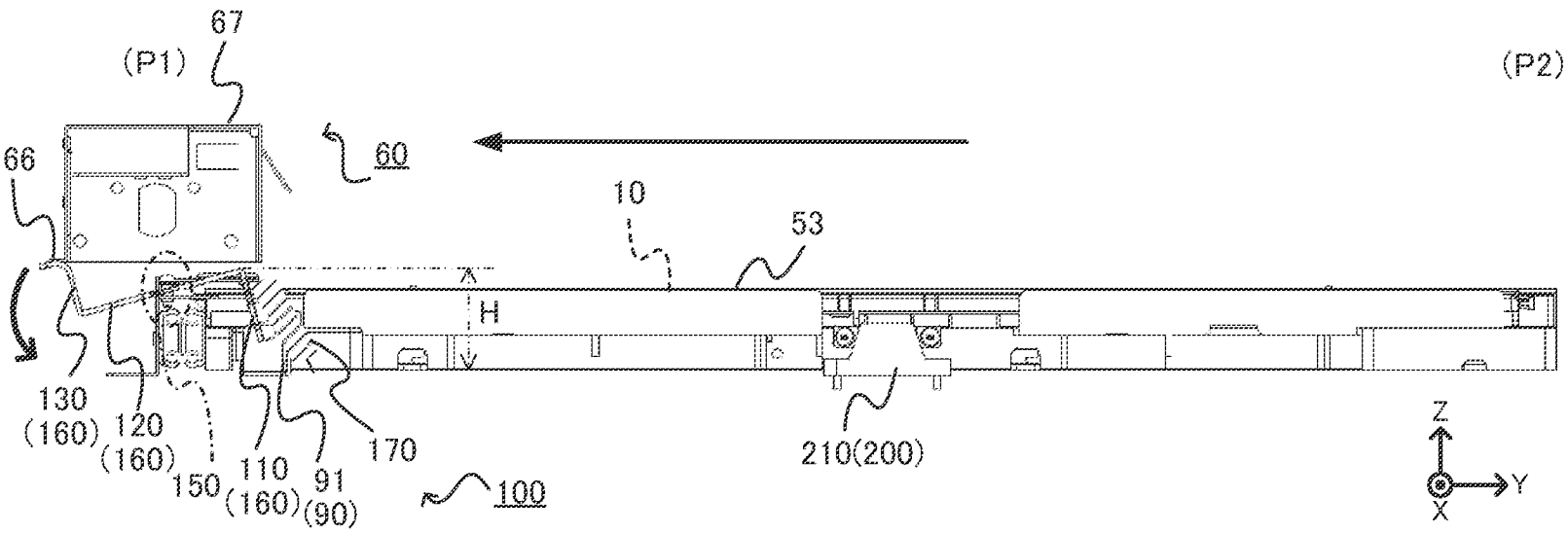
FIG. 19A a back view illustrating a tray locker, in which the irradiator according to an embodiment of the present disclosure is positioned at a first position.
Figure 19B:
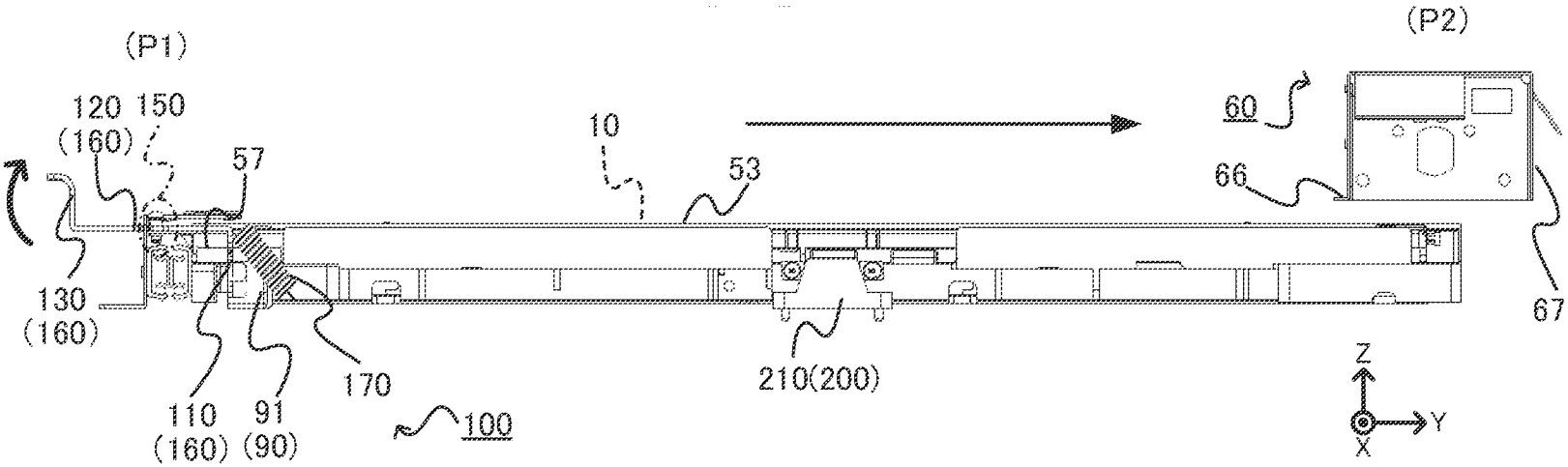
FIG. 19B is a back view illustrating the tray locker, in which the irradiator according to an embodiment of the present disclosure is positioned at a position away from the first position.

The connector 120 is a roughly rectangular plate-like member. The connector 120 connects the retaining claw 110 to the lever 130. A first end of the connector 120 is connected to the retaining claw 110, and a second end of the connector 120 is connected to the lever 130. When the retaining claw 110 is locked to the retainer 91, the connector 120 is substantially parallel to the XY plane. A pair of notches 121, 121 is provided in opposing side surfaces of the connector 120. The connector 120 includes a pivot hole 122 between the notches 121, 121. A riser 142 (described later) of the fixer 140 is loosely inserted into the pair of notches 121, 121. Due to this configuration, the connector 120 (the tray locking hardware 160) engages with the fixer 140. The pivoter 150 illustrated in FIG. 9 is constituted from the pair of notches 121, 121 and the riser 142. As illustrated in FIGS. 19A and 19B, the pivoter 150 functions as a rotational shaft, which extends in the +X-direction or the −X-direction, of the tray locking hardware 160 (the connector 120).

As illustrated in FIG. 15, the lever 130 is a roughly rectangular plate-like member, and includes a curved surface near the tip thereof. The lever 130 includes a base 131 extending in the +Z-direction from the second end of the connector 120, and an abutter 132 that includes a curved surface extending from the base 131 and a flat surface extending from the curved surface. The curved surface of the abutter 132 bends toward the −Y-direction. The flat surface of the abutter 132 extends in the −Y-direction. As illustrated in FIG. 19A, when the irradiator 60 is positioned at the first position P1, the curved surface extending from the base 131 of the lever 130 is pushed in the −Y-direction by the pusher 66 of the irradiator 60. Due to the pressing force applied to the abutter 132 of the lever 130 by the pusher 66 of the irradiator 60, the tray locking hardware 160 (the connector 120) pivots counter-clockwise (when viewed from the +X-direction) about the pivoter 150. As a result, the retaining claw 110 disengages from the retainer 91 and the user can slide the tray 53 in the +X-direction. Note that, as illustrated in FIG. 19A, due to the abutter 132 being bent toward the −Y-direction, the height H that the top end of the retaining claw 110 side of the tray locking hardware 160 reaches can be restricted to a height that does not contact the irradiator 60. As a result of this configuration, even if the irradiator 60 moves beyond the first position P1 in the −Y-direction, the top end of the retaining claw 110 side of the tray locking hardware 160 can be prevented from contacting the irradiator 60.

Figure 18A:
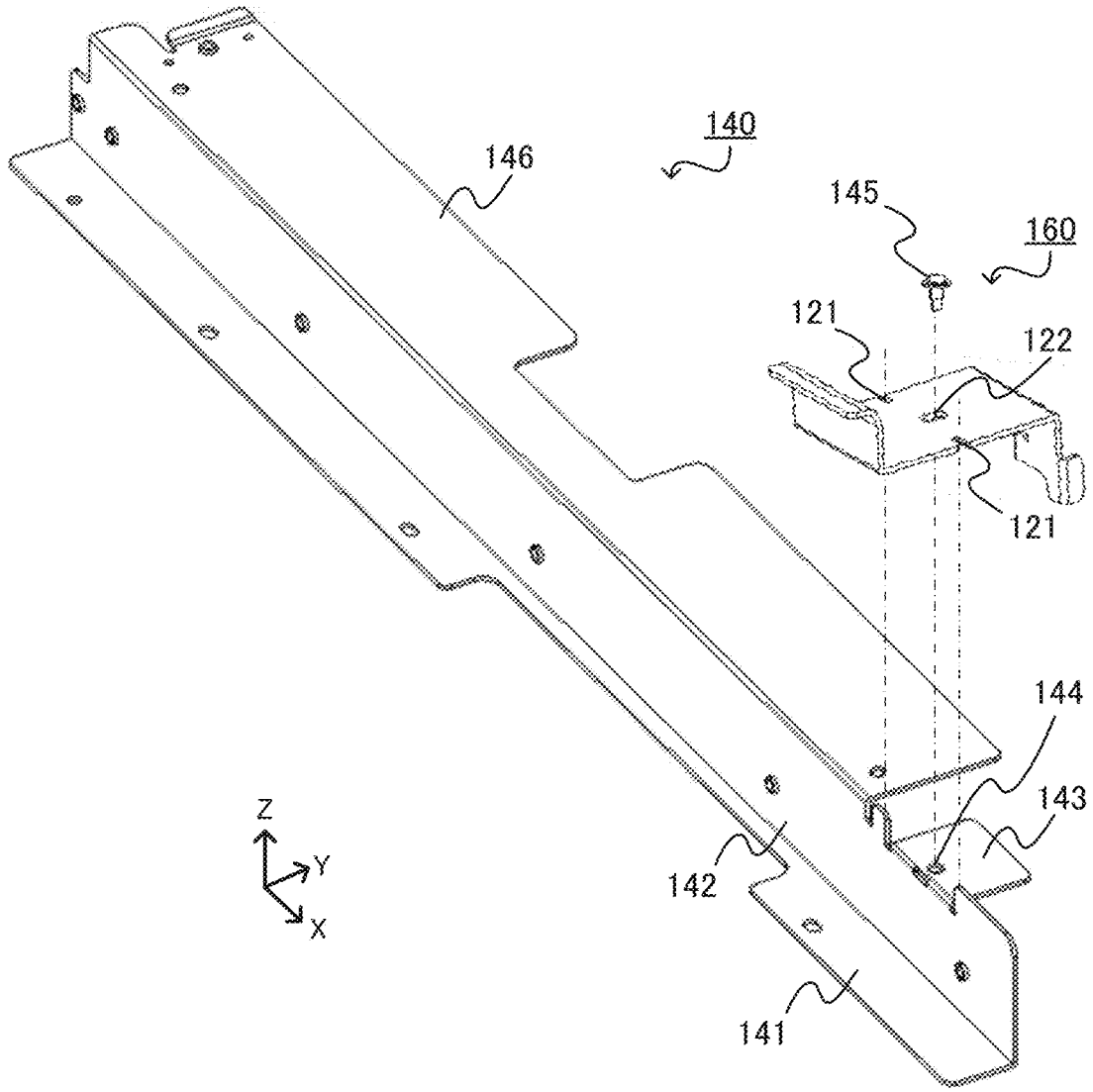
FIG. 18A is a perspective view illustrating a fixer of the expansion device according to an embodiment of the present disclosure.
Figure 18B:
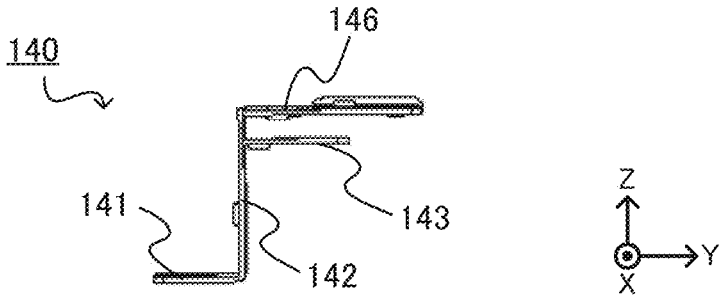
FIG. 18B is a front view illustrating the fixer of the expansion device according to an embodiment of the present disclosure.

As illustrated in FIGS. 18A and 18B, the fixer 140 is formed by machining a plate-like member such that a cross-section thereof (when viewed on the YZ plane) has a step shape. The fixer 140 includes a leg 141 that is disposed on the bottom surface 51*c* of the upper housing 51*a*, the riser 142 extending from a first end of the leg 141, a mount 143 on which the tray locking hardware 160 is mounted, and a slide rail cover 146 that covers the slide rail from above. The leg 141 extends in the −X-direction on the bottom surface 51*c*. The riser 142 extends in the +Z-direction from the leg 141. The mount 143 is provided parallel to the XY plane, near the +X-direction side end of the riser 142. The mount 143 includes an adjustment hole 144 for attaching an adjustment member (auxiliary member) 145. The adjustment hole 144 is provided at a position that corresponds to the pivot hole 122 of the connector 120 of the tray locking hardware 160. In one example, the adjustment member 145 is a screw. The connector 120 of the tray locking hardware 160 is mounted on the mount 143 while the riser 142 is loosely inserted into the notches 121, 121 of the connector 120. The adjustment member 145 is loosely inserted into the pivot hole 122 of the tray locking hardware 160 and attached to the adjustment hole 144 of the mount 143. The pivoting range of the tray locking hardware 160 (the connector 120) and the pivoter 150 is restricted by the position in the +Z-direction of the screw head of the adjustment member 145. The adjustment member 145 prevents the tray locking hardware 160 from falling off and also prevents misalignment of the tray locking hardware 160. Restricting the pivoting range of the pivoter 150 makes it possible to prevent the tray locking hardware 160 from coming in contact with components of the irradiator 60 other than the pusher 66. The slide rail cover 146 is provided parallel to the XY plane, at positions other than near the +X-direction side end of the riser 142. The position of the slide rail cover 146 in the +Z-direction is higher than that of the mount 143.

As illustrated in FIG. 9, the top end of the elastic member 170 is attached to the attachment hole 111 of the retaining claw 110, and the bottom end is attached to the bottom surface 51*c* of the upper housing 51*a*. In one example, the elastic member 170 is a coil spring. When viewed from the +X-direction, the elastic member 170 energizes the tray locking hardware 160 in the clockwise direction. As a result of this configuration, when the irradiator 60 is positioned at a position away from the first position P1 as illustrated in FIG. 19B, the retaining claw 110 is locked to the retainer 91 and the tray 53 is locked so as not to move in the +X-direction.

The push latch (the latch) 200 is a member that restricts the −X-direction movement of the tray 53. The push latch 200 includes a conventional knock cam mechanism. As illustrated in FIG. 13, the push latch 200 includes a main body 210, a slider 220, an arm 230, and a yoke 240. Note that, while the engager 58 is also a constituent of the push latch 200, in this specification, the engager 58 is described as a constituent of the tray 53. The push latch 200 is provided on the bottom surface 51*c*. The push latch 200 is disposed at a position that engages with the engager 58 of the tray 53 (on the +X-direction side and near the middle between the first position P1 and the second position P2).

The main body 210 is a member that has a hat-shaped cross-section. The main body 210 is disposed on the bottom surface 51*c*. The main body 210 includes a recess 211 that has a rectangular cross-section. The slider 220 and the arm 230 are housed in the recess 211. The main body 210 includes an urging member (not illustrated in the drawings) on the +X-direction side of the recess 211.

Figure 14A:
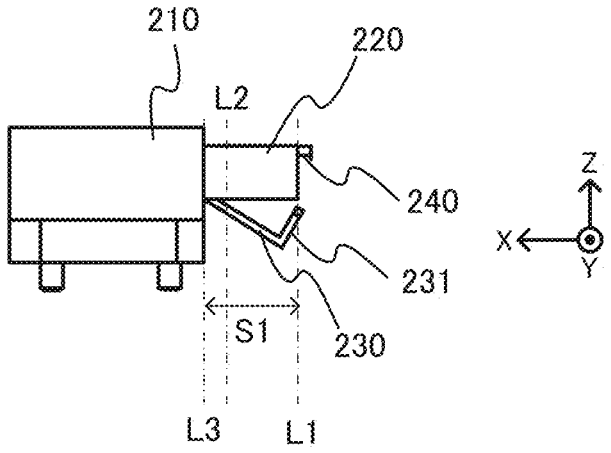
FIG. 14A is a side view illustrating a state in which a tip of an arm of the push latch according to an embodiment of the present disclosure is positioned at an extended position.
Figure 14B:
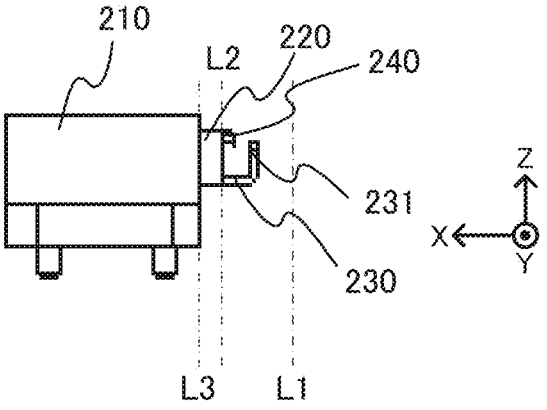
FIG. 14B is a side view illustrating a state in which the tip of the arm of the push latch according to an embodiment of the present disclosure is positioned at a storage position.
Figure 14C:
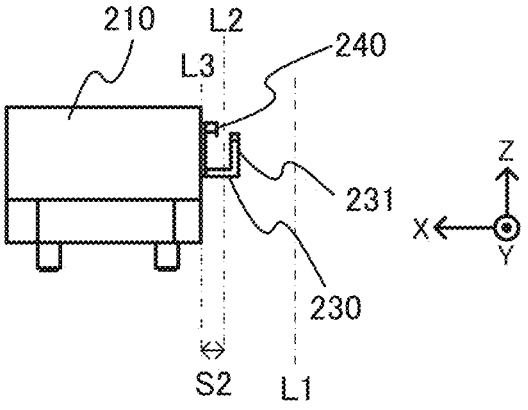
FIG. 14C is a side view illustrating a state in which the tip of the arm of the push latch according to an embodiment of the present disclosure is positioned at a pushed-in position.

The slider 220 is a member that has an H-shaped cross-section. The slider 220 is disposed in the recess 211. The arm 230 is pivotably connected to a lower portion of the slider 220. The yoke 240 is provided on an upper portion of the slider 220. As illustrated in FIGS. 14A to 14C, the slider 220 slides between an extended position L1, a stored position L2, and a pushed-in position L3. When the slider 220 is positioned at the extended position L1, if the slider 220 is pushed a distance S1 in the +X-direction to the pushed-in position L3, the slider 220 will be pushed back by the knock cam mechanism of the push latch 200 and the urging force of the urging member. As a result, the slider 220 moves to the stored position L2 and stops. When the slider 220 moves to the stored position L2, the push latch 200 locks and the slider 220 is incapable of movement in the −X-direction. When the slider 220 is positioned at the stored position L2, if the slider 220 is pushed a distance S2 in the +X-direction to the pushed-in position L3, the slider 220 will be pushed back by the knock cam mechanism of the push latch 200 and the urging force of the urging member and move to the extended position L1. When the slider 220 has moved to the extended position L1, the locking of the push latch 200 is released.

The arm 230 is a metal plate-like member that includes a hook 231 at one end thereof. The hook 231 is bent in the +Z-direction. When the slider 220 is positioned at the pushed-in position L3 and the stored position L2, the arm 230 is supported by the recess 211 and, as a result, is substantially parallel to the XY plane. As the slider 220 is slid from the stored position L2 to the extended position L1, the arm 230 pivots such that the hook 231 moves in the −Z-direction. When the slider 220 is positioned at the pushed-in position L3 and the stored position L2, the hook 231 engages with the engager 58 of the tray 53. The engagement between the hook 231 and the engager 58 of the tray 53 is released as a result of the slider 220 moving toward the extended position L1.

The yoke 240 is a metal rectangular member that is magnetized. The yoke 240 projects farther in the −X-direction than the slider 220. Moreover, the yoke 240 is disposed at a position that abuts against the engager 58 of the tray 53. Due to this configuration, when the tray 53 is pushed in the +X-direction, the yoke 240 becomes affixed to the metal engager 58 and is pushed by the engager 58. As a result, the slider 220 is slid from the extended position L1 toward the stored position L2 and the pushed-in position L3.

The barcode reader 65 illustrated in FIG. 12A functions as a reading device that reads the barcodes B provided on the back side of the thermally expandable sheet 10. The barcode reader 65 includes a light source and an optical sensor. The barcode reader 65 optically reads the barcodes B by a well-known method. The barcode reader 65 is attached to the irradiator 60. Accordingly, the barcode reader 65 moves together with the irradiator 60.

The power supply 69 supplies the necessary power to the various components in the expansion device 50. The ventilator 54, the transportation motor 55, the lamp heater 61, the cooler 64, and the like operate on the basis of the power supplied by the power supply 69. The power supply 69 includes an inverter, a power supply integrated circuit (IC), and the like.

The controller 70 is provided on a substrate disposed in the lower housing 51*b*. The controller 70 includes a CPU, and memory such as ROM and RAM. The controller 70 is connected to the various components of the expansion device 50 via transmission paths, that is, a system bus, that transmits commands and data. The controller 70 includes a hard disk, a timekeeping device (for example, a real time clock (RTC)), and a communication interface for communicating with the terminal device 30.

In the controller 70, the CPU reads a control program stored in the ROM and uses the RAM as working memory to control the operations of the expansion device 50. Specifically, the controller 70 controls the transportation motor 55 to move the irradiator 60 in a specified direction, at a specified movement speed. Moreover, the controller 70 causes the irradiator 60 to irradiate the electromagnetic waves. Additionally, the controller 70 causes the barcode reader 65 to read the barcodes B.

Expansion Processing

The controller 70 irradiates the thermally expandable sheet 10, on which the heat conversion layer is printed by the printing device 40, with electromagnetic waves, thereby causing the thermally expandable sheet 10 to distend.

Figure 20:
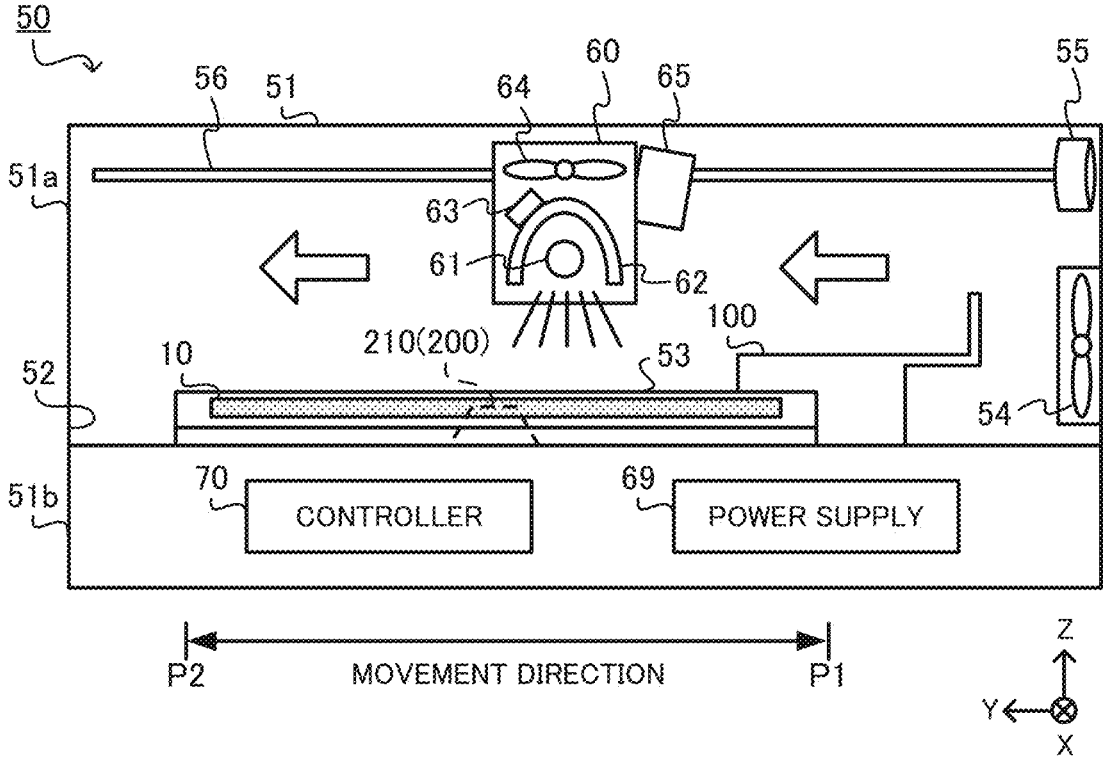
FIG. 20 is a schematic diagram illustrating expansion processing of the expansion device according to an embodiment of the present disclosure.

FIG. 20 illustrates the expansion processing of the expansion device 50. In the expansion processing, the controller 70 supplies power to the irradiator 60, thereby causing the lamp heater 61 to turn on. Then, the controller 70 causes the irradiator 60 to irradiate electromagnetic waves and while driving the transportation motor 55. As a result, the controller 70 causes the irradiator 60 to move a specified distance from the first position P1 toward the second position P2, that is, in the first direction. Thus, the controller 70 causes the irradiator 60 to move from one edge of the thermally expandable sheet 10 to the other edge of the thermally expandable sheet 10, thereby, causing the thermally expandable sheet 10 to be thoroughly irradiated with the electromagnetic waves.

The specified distance is determined depending on the size of the thermally expandable sheet 10. In one example, when the size of the thermally expandable sheet 10 is A3 (297 mm×420 mm), the specified distance is the distance from the first position P1 to the second position P2. When the size of the thermally expandable sheet 10 is A4 (210 mm×297 mm), the specified distance is half the distance from the first position P1 to the second position P2.

When the thermally expandable sheet 10 is irradiated with the electromagnetic waves by the irradiator 60, the portions of the thermally expandable sheet 10 where the heat conversion layer is printed generate heat. The thermally expandable material in the thermally expansive layer 12 is heated to the expansion starting temperature or higher and distends. As a result, the thermally expansive layer 12 bulges.

The expansion starting temperature is the temperature at which the thermally expandable material starts to expand. The expansion starting temperature differs depending on the thermally expandable material. In one example, the expansion starting temperature is about 80° C. to about 120° C. The controller 70 causes the irradiator 60, which is irradiating electromagnetic waves at a predetermined intensity, to move at a predetermined speed, thereby heating the portions of the thermally expandable sheet 10 where the heat conversion layer is printed to the expansion starting temperature or higher. The predetermined intensity and the predetermined speed are set in advance such that the thermally expandable material will be heated to the expansion starting temperature or higher.

Thus, the controller 70 causes the thermally expansive layer 12 of the thermally expandable sheet 10 to distend by causing the irradiator 60 to move in the first direction by the transportation motor 55 and causing the irradiator 60 to irradiate electromagnetic waves. The portions of the thermally expandable sheet 10 where the heat conversion layer is printed distend to heights corresponding to the concentration of the heat conversion layer. As a result, the desired shaped object is formed on the thermally expandable sheet 10.

The irradiator 60 arrives at the second position P2 as a result of the expansion processing. After the expansion processing, the controller 70 causes the irradiator 60 to move from the second position P2 toward the first position P1 or, in other words, returns the irradiator 60 to the initial position and, at the same time, as necessary, executes ventilation processing by the ventilator 54 or cooling processing by the cooler 64. Specifically, the controller 70 causes the ventilator 54 to drive, thereby exhausting the air in the housing 51, which is heated by the expansion processing, out of the housing 51. Additionally, the controller 70 causes the cooler 64 to operate, thereby cooling the irradiator 60 and the thermally expandable sheet 10, which are heated by the expansion processing.

Figure 21:
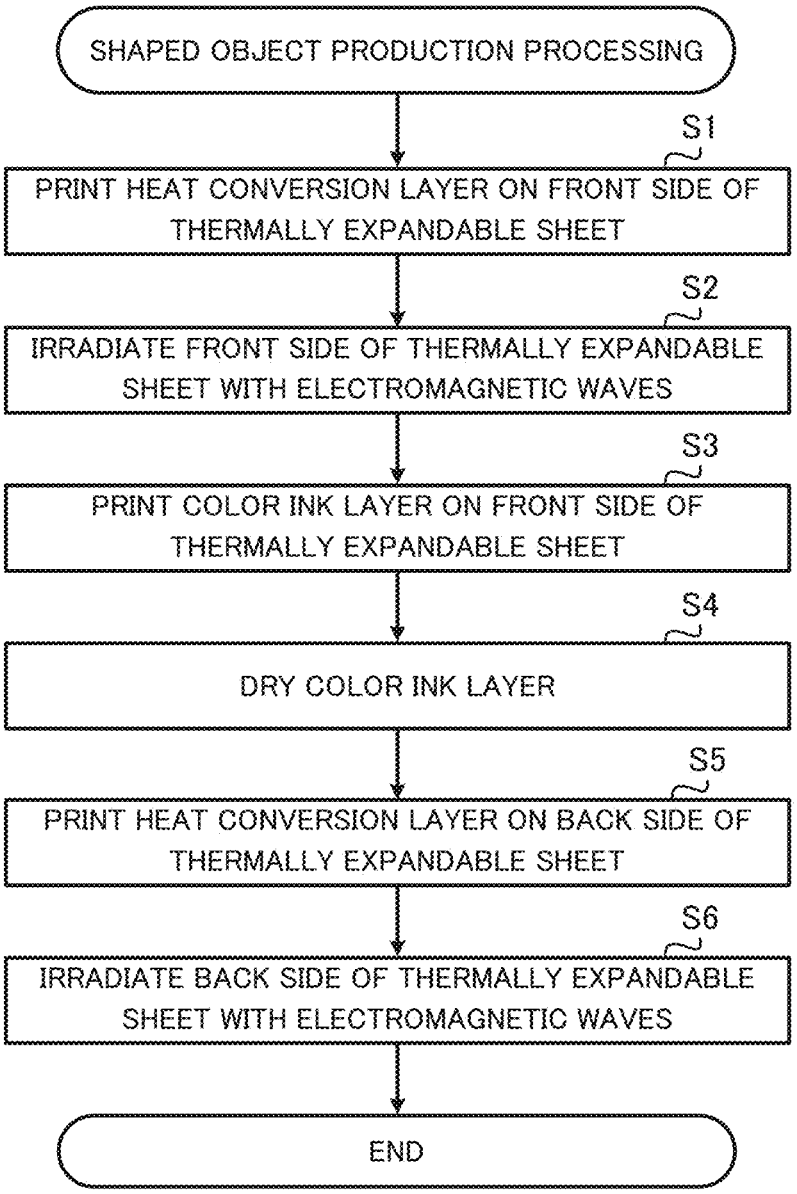
FIG. 21 is a flowchart illustrating production processing of a shaped object, executed by the shaping system according to an embodiment of the present disclosure.

Next, a description will be given of the production processing of the shaped object executed by the printing device 40 and the expansion device 50 while referencing the flowchart illustrated in FIG. 21 and the cross-sectional views of the thermally expandable sheet 10 illustrated in FIGS. 22A to 22E.

Figure 22A:
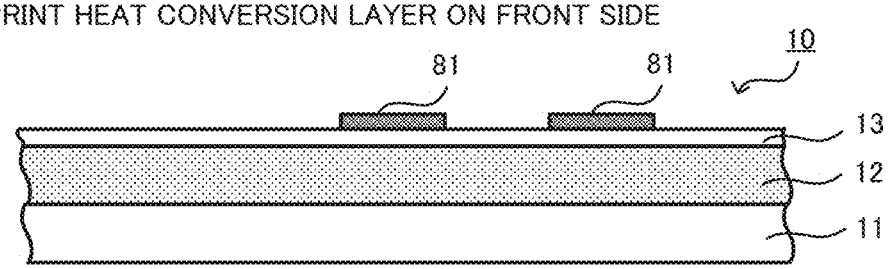
FIG. 22A is a schematic drawing for explaining a step of printing a heat conversion layer on the front side of the thermally expandable sheet according to an embodiment of the present disclosure.

First, the user prepares a thermally expandable sheet 10 in which shaped objects have not been formed. Additionally, the user designates the data of the color image, the front side foaming data, and the back side foaming data using the terminal device 30. Next, the user sets the thermally expandable sheet 10 in the printing device 40 with the front side facing the +Z-direction. The printing device 40 prints a heat conversion layer (front side conversion layer 81) on the front side of the thermally expandable sheet 10 (step S1). The front side conversion layer 81 is formed from an ink that contains an electromagnetic wave heat conversion material (for example, carbon black). The printing device 40 discharges the electromagnetic wave heat conversion material-containing ink onto the front side of the thermally expandable sheet 10 on the basis of the designated front side foaming data. As a result, the front side conversion layer 81 is formed on the ink receiving layer 13, as illustrated in FIG. 22A. Note that, in FIG. 22A, to facilitate comprehension, an example is illustrated in which the front side conversion layer 81 is formed on the ink receiving layer 13. However, more accurately, since the ink is received into the ink receiving layer 13, the front side conversion layer 81 is formed in the ink receiving layer 13.

Figure 22B:
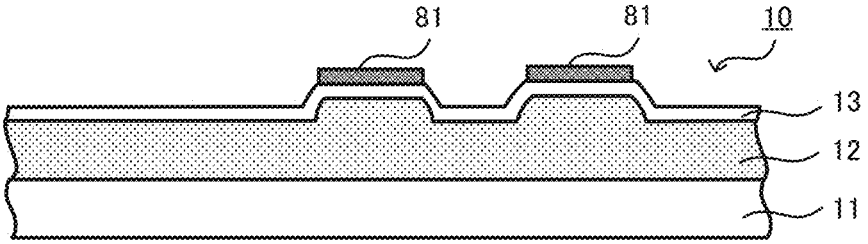
FIG. 22B is a schematic drawing for explaining a step of irradiating, with electromagnetic waves, the front side of the thermally expandable sheet according to an embodiment of the present disclosure.

Second, the user sets the thermally expandable sheet 10 onto which the front side conversion layer 81 is printed in the expansion device 50 with the front side facing the +Z-direction. The expansion device 50 irradiates the set thermally expandable sheet 10 with electromagnetic waves from the front surface side (step S2). Specifically, the irradiator 60 of the expansion device 50 irradiates the front side of the thermally expandable sheet 10 with electromagnetic waves. The heat conversion material, included in the front side conversion layer 81 printed on the front side of the thermally expandable sheet 10, absorbs the irradiated electromagnetic waves, thereby generating heat. As a result, the front side conversion layer 81 generates heat and, as illustrated in FIG. 22B, the region of the thermally expansive layer 12 of the thermally expandable sheet 10 corresponding to the front side conversion layer 81 distends and rises.

In step S2, the tray 53 on which the thermally expandable sheet 10 is disposed is inserted into the upper housing 51*a* in the +X-direction to set the thermally expandable sheet 10 in the expansion device 50. When the tray 53 is inserted into the upper housing 51*a*, the engager 58 of the tray 53 pushes the yoke 240 of the push latch 200. When the slider 220 of the push latch 200 positioned at the extended position L1 is pushed to the pushed-in position (the predetermined position) L3, the slider 220 is pushed back by the knock cam mechanism of the push latch 200 and the urging force of the elastic member, moves to the stored position L2, and stops. When the slider 220 has moved to the stored position L2 and stopped, the push latch 200 locks and, as a result, the slider 220 becomes incapable of movement in the −X-direction. Furthermore, since the engager 58 of the tray 53 is engaged with the hook 231 of the push latch 200, the user cannot pull the tray 53 out in the −X-direction.

When the irradiator 60 starts to separate from the first position P1, the pressing force applied to the abutter 132 of the lever 130 of the tray locking hardware 160 by the pusher 66 of the irradiator 60 gradually weakens. Accordingly, when the irradiator 60 starts to separate from the first position P1, when viewed from the +X-direction, the tray locking hardware 160 pivots clockwise due to he urging force of the elastic member 170. That is, when viewed from the +X-direction, the tray locking hardware 160 pivots clockwise about the pivoter 150 so that the connector 120 of the tray locking hardware 160 becomes parallel to the XY plane. When the pusher 66 of the irradiator 60 separates from the lever 130 of the tray locking hardware 160, the retaining claw 110 is inserted into the retainer 91 and locks due to the urging force of the elastic member 170. When the tray 53 is moved in the +X-direction, the locked retaining claw 110 comes in contact with the side wall 57*a* of the retaining claw abutment 57 of the tray 53. As a result, the +X-direction movement of the tray 53 is obstructed by the retaining claw 110, and the tray 53 is locked so as to be incapable of movement in the +X-direction. Since the tray 53 is locked so as to be incapable of movement in the +X-direction in the housing 51, the locking of the push latch 200 cannot be released. Since the locking of the push latch 200 cannot be released, the tray 53 cannot be moved in the −X-direction either.

Figure 23A:
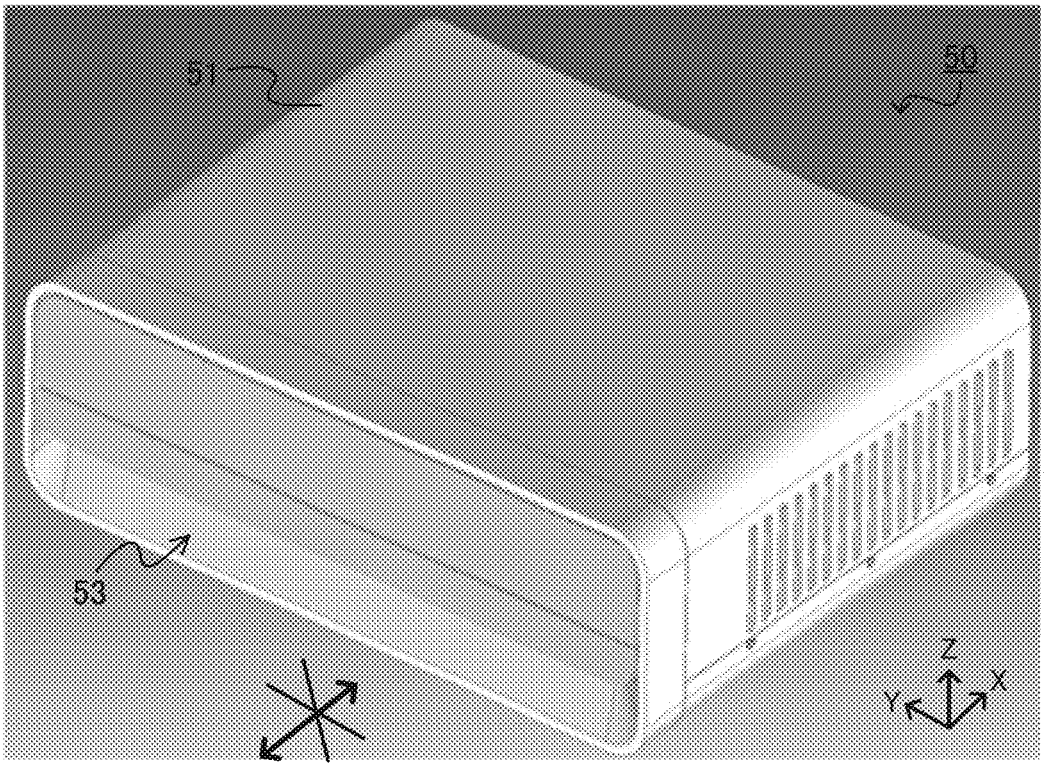
FIG. 23A is a perspective view illustrating a state in which the tray of the expansion device according to an embodiment of the present disclosure is locked.

Thus, the tray 53 is locked and cannot be moved in the +X-direction or the −X-direction (FIG. 23A). The tray locker 100 maintains the locked state of the tray 53 during the period when the irradiator 60 is irradiating the electromagnetic waves on the thermally expandable sheet 10. When the irradiator 60 returns to the first position P1, the pressing force applied to the abutter 132 of the lever 130 of the tray locking hardware 160 by the pusher 66 of the irradiator 60 gradually strengthens. Moreover, the pressing force from the pusher 66 of the irradiator 60 becomes greater than the urging force of the elastic member 170. When the pressing force from the pusher 66 of the irradiator 60 becomes greater than the urging force of the elastic member 170, when viewed from the +X-direction, the tray locking hardware 160 pivots clockwise about the pivoter 150 due to the pressing force from the pusher 66 (FIG. 19A). Specifically, the pusher 66 contacts the abutter 132 due to the movement of the moving head (the irradiator) 60 and the lever 130 is pushed due to the movement of the moving head 60, thereby causing the tray locking hardware 160 (the lever 130, the connector 120, and the retaining claw 110) to pivot.

The pusher 66 of the irradiator 60 continues to press on the lever 130 with pressing force that is greater than the urging force of the elastic member 170. As a result, the retaining claw 110 disengages from the retainer 91, and the tray 53 is allowed to move in the +X-direction.

Figure 23B:
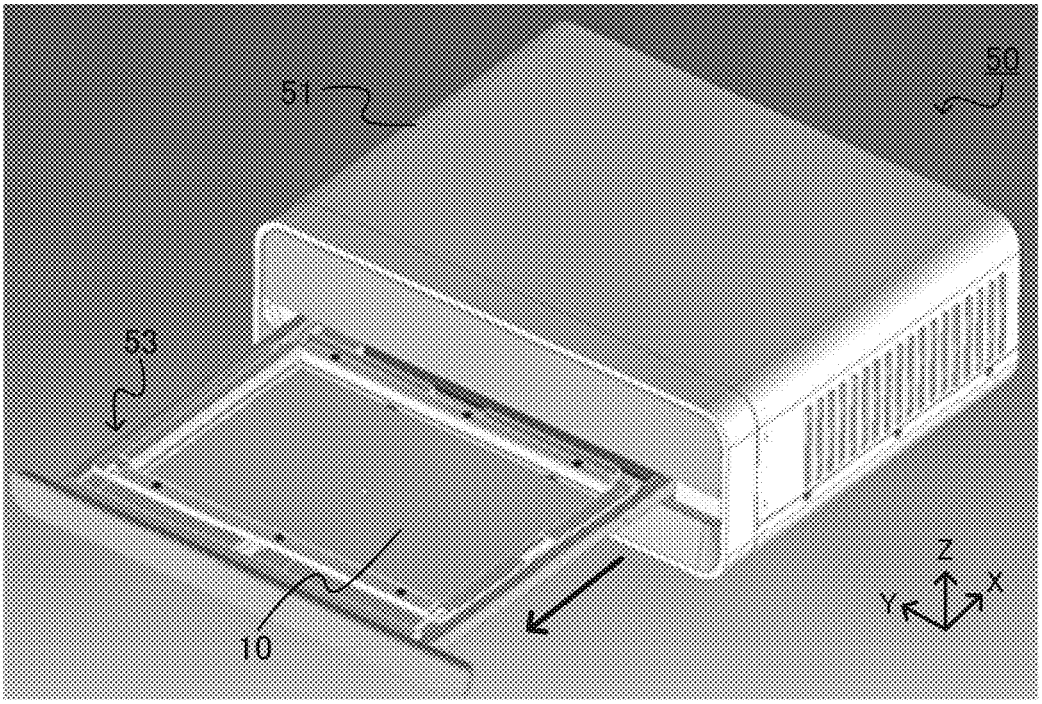
FIG. 23B is a perspective view illustrating a state in which the locking of the tray of the expansion device according to an embodiment of the present disclosure is released.

Since the tray 53 is allowed to move in the +X-direction, the locking of the push latch 200 can be released by the user pushing the tray 53 in the +X-direction and pushing the slider 220 of the push latch 200 to the pushed-in position L3. When the locking of the push latch 200 is released, the slider 220 of the push latch 200 is pushed back to the extended position L1, the hook 231 of the push latch 200 pivots in the −Z-direction, and the engagement between the push latch 200 and the tray 53 is released. As a result, the user can pull the tray 53 out in the −X-direction, as illustrated in FIG. 23B. Thus, the user can remove the processed thermally expandable sheet 10. Note that the shapes and dimensions of the retaining claw 110 and the retainer 91 must be designed so that the tray 53 does not move more than the distance S2 in the +X-direction while the retaining claw 110 is locked to the retainer 91.

Figure 22C:
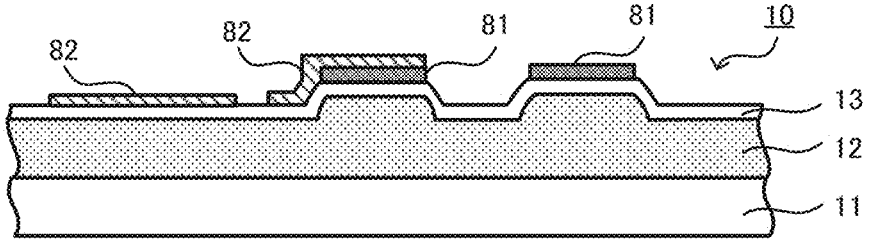
FIG. 22C is a schematic drawing for explaining a step of printing a color ink layer on the front side of the thermally expandable sheet according to an embodiment of the present disclosure.

Third, the user sets the thermally expandable sheet 10, of which a portion of the thermally expansive layer 12 is caused to distend, in the printing device 40 with the front side facing the +Z-direction. The printing device 40 prints a color image (that is, the color ink layer 82) on the front side of the thermally expandable sheet 10 (step S3). Specifically, the printing device 40 discharges the various cyan (C), magenta (M), and yellow (Y) inks onto the front side of the thermally expandable sheet 10 on the basis of the color image data. As a result, the color ink layer 82 is formed on the ink receiving layer 13 and the front side conversion layer 81, as illustrated in FIG. 22C. Note that, in FIG. 22C, to facilitate comprehension, an example is illustrated in which the color ink layer 82 is formed on the ink receiving layer 13. However, more accurately, the color ink is received into the ink receiving layer 13.

Fourth, after the color ink layer 82 is printed on the thermally expandable sheet 10, the color ink layer 82 is dried (step S4). In one example, the user sets the thermally expandable sheet 10 onto which the color ink layer 82 is printed in the expansion device 50 with the back side facing the +Z-direction. The expansion device 50 heats the thermally expandable sheet 10 from the back side, thereby drying the color ink layer 82 printed on the front side of the thermally expandable sheet 10. Specifically, the irradiator 60 of the expansion device 50 irradiates the back side of the thermally expandable sheet 10 with the electromagnetic waves and heats the color ink layer 82. As a result, the solvent included in the color ink layer 82 volatilizes, thereby causing the color ink layer 82 to dry. Note that step S4 can be omitted. Additionally, in step S4, the locking and releasing of the locking of the tray 53 is performed.

Figure 22D:
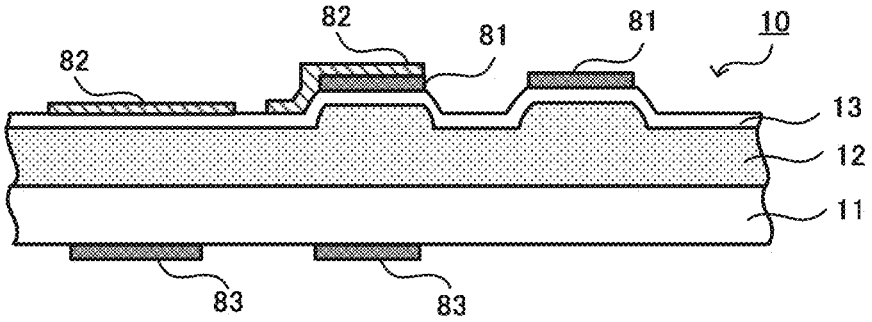
FIG. 22D is a schematic drawing for explaining a step of printing a heat conversion layer on the back side of the thermally expandable sheet according to an embodiment of the present disclosure.

Fifth, the user inserts the thermally expandable sheet 10 onto which the color ink layer 82 is printed into the printing device 40 with the back side facing the +Z-direction. The printing device 40 prints a heat conversion layer (back side conversion layer 83) on the back side of the thermally expandable sheet 10 (step S5). Similar to the front side conversion layer 81, the back side conversion layer 83 is formed from an ink that contains electromagnetic wave heat conversion material. The printing device 40 discharges the ink that contains the electromagnetic wave heat conversion material onto the back side of the thermally expandable sheet 10 on the basis of the back side foaming data. As a result, the back side conversion layer 83 is formed on the back side of the base 11, as illustrated in FIG. 22D.

Figure 22E:
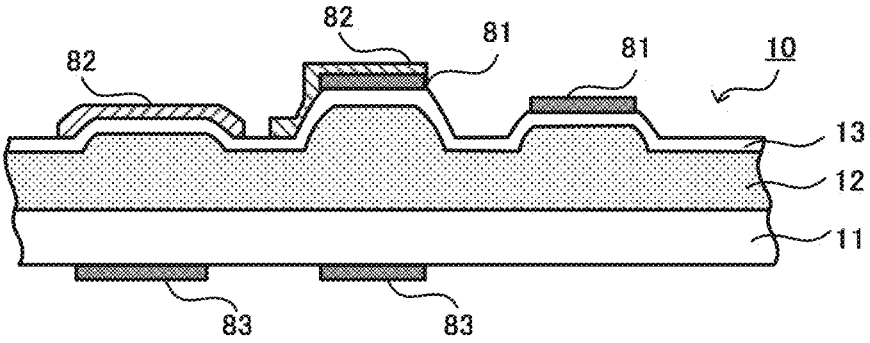
FIG. 22E is a schematic drawing for explaining a step of irradiating, with electromagnetic waves, the back side of the thermally expandable sheet according to an embodiment of the present disclosure.

Sixth, the user sets the thermally expandable sheet 10 onto which the back side conversion layer 83 is printed in the expansion device 50 with the back side facing the +Z-direction. The expansion device 50 irradiates the thermally expandable sheet 10 from the back side with the electromagnetic waves, and heats the thermally expansive layer 12 of the thermally expandable sheet 10 (step S6). Specifically, the irradiator 60 of the expansion device 50 irradiates the back side of the thermally expandable sheet 10 with the electromagnetic waves. The back side conversion layer 83 printed on the back side of the thermally expandable sheet 10 absorbs the irradiated electromagnetic waves, thereby generating heat. As a result, as illustrated in FIG. 22E, the region of the thermally expansive layer 12 of the thermally expandable sheet 10 corresponding to the back side conversion layer 83 distends and rises. Additionally, in step S6, the locking and releasing of the unlocking of the tray 53 is performed.

The shaped object is formed on the surface of the thermally expandable sheet 10 as a result of carrying out the processing described above.

Note that configurations are possible in which the heat conversion layer is formed only on the front side or on the back side. In cases in which only the front side conversion layer 81 is formed on the thermally expandable sheet 10 to cause the thermally expansive layer 12 to distend, steps S1 to S4 are carried out. In cases in which only the back side conversion layer 83 is formed on the thermally expandable sheet 10 to cause the thermally expansive layer 12 to distend, steps S3 to S6 are carried out.

A configuration is possible in which steps S5 and S6 are carried out before steps S1 and S2. A configuration is possible in which steps S3 and S4 are carried out before steps S1 and S2. A configuration is possible in which steps S1 and S3 are carried out and, thereafter, step S2 is carried out. Thus, the sequence in which steps S1 to S6 are carried out may be changed.

As described above, with the expansion device 50 according to the present embodiment, the slider 220 of the push latch 200 is slid to the pushed-in position L3 due to the tray 53 being pushed and, thereafter, is pushed back by the urging member and stops at the stored position L2. In this case, the movement of the tray in the +X-direction and the −X-direction is locked by the knock cam mechanism of the push latch 200 and the engagement between the hook 231 of the push latch 200 and the engager 58 of the tray 53.

Moreover, with the expansion device 50 according to the present embodiment, when the irradiator 60 separates from the first position P1 in order to irradiate the thermally expandable sheet 10 with the electromagnetic waves, the retaining claw 110 of the tray locking hardware 160 is inserted into the retainer 91 due to the urging force of the elastic member 170, and is locked. Since the locked retaining claw 110 comes in contact with the side wall 57*a* of the retaining claw abutment 57 of the tray 53, movement of a predetermined distance in the +X-direction of the tray 53 is obstructed by the retaining claw 110. As a result, the expansion device 50 can obstruct the releasing of the locking of the push latch 200.

With the expansion device 50, the irradiator 60 irradiates the thermally expandable sheet 10 with the electromagnetic waves and, thereafter, returns to the first position P1. The irradiator 60 that has returned to the first position P1 pushes the lever 130 of the tray locking hardware 160. As a result, the retaining claw 110 of the tray locking hardware 160 disengages from the retainer 91, thereby allowing the user to move the tray 53 a predetermined distance in the +X-direction. By moving the tray 53 the predetermined distance in the +X-direction, the locking of the push latch 200 is released, thereby allowing the tray 53 to be moved in the −X-direction.

Thus, the expansion device 50 uses the push latch 200, the urging force of the elastic member 170, and the movement of the irradiator 60 to lock the tray 53 so as to prevent movement in the +X-direction and the −X-direction during the period in which the thermally expandable sheet 10 is being irradiated with the electromagnetic waves by the irradiator 60. Accordingly, the expansion device 50 can lock the movement of the tray using a simple structure. Moreover, with the expansion device 50, since a sensor is not used in the tray locking operations, it is possible to prevent situations in which the locking of the tray fails due to a sensor malfunction. Additionally, with the expansion device 50, since the direction in which the tray is inserted and removed and the direction in which the irradiator 60 moves back and forth cross each other, it is possible to release the locking of the tray after moving the irradiator 60 to a position out of reach of the user. This configuration makes it possible for the user to safely replace the thermally expandable sheet 10.

Modified Examples

Embodiments of the present disclosure are described above, but these embodiments are merely examples and do not limit the scope of application of the present disclosure. That is, various applications of the embodiments of the present disclosure are possible, and all embodiments are included in the scope of the present disclosure.

For example, in the embodiment described above, the elastic member 170 is a coil spring, but configurations are possible in which the elastic member 170 is rod-shaped rubber, a plate spring, or the like. Moreover, a configuration is possible in which the elastic member 170 is not provided. For example, the center of gravity of the tray locking hardware 160 may be adjusted such that the retaining claw 110 locks to the retainer 91 when the irradiator 60 is positioned at a position away from the first position P1. The center of gravity of the tray locking hardware 160 can be adjusted by changing the arrangements of the retaining claw 110 and the lever 130, the weights of the retaining claw 110 and the lever 130, the arrangement of the pair of notches 121, 121, and the like.

In the embodiment described above, the tray locking mechanism 2 was used in the expansion device 50 that causes the thermally expandable sheet 10 to distend. However, a configuration is possible in which the tray locking mechanism 2 is used in a different device. For example, the tray locking mechanism 2 may be used in a fused deposition modeling (FDM) type 3D printer that includes a moving discharge head (nozzle) that generates a shaped object on a molding table. Additionally, the tray locking mechanism 2 may be used in a printing device that includes a moving print head that prints on printing paper. Moreover, the tray locking mechanism 2 may be used in a printing device that includes the print head 42 instead of the irradiator 60 of the expansion device 50. The target of the processing is not limited to the thermally expandable sheet 10. For example, the tray locking mechanism 2 or the tray locker (locking mechanism) 100 may be used in a device in which a head acts on an object.

In the embodiment described above, the tray locking hardware 160 includes the retaining claw 110, the connector 120, and the lever 130. However, a configuration is possible in which the tray locking hardware 160 has a doglegged shape and includes only the retaining claw 110 and the lever 130.

In the embodiment described above, the abutter 132 of the tray locking hardware 160 includes the curved surface that bends from the base 131 toward the −Y-direction and the flat surface that extends from the curved surface in the −Y-direction. However, a configuration is possible in which the abutter 132 has a flat surface that is inclined 45° with respect to the +Z-direction when viewed from the +X-direction, instead of the curved surface that bends toward the −Y-direction. It is sufficient that the abutter 132 is formed such that the upper end on the retaining claw 110 side of the tray locking hardware 160 does not come in contact with the irradiator 60.

In the embodiment described above, the pivoting range of the pivoter 150 and the tray locking hardware 160 (the connector 120) is restricted by the +Z-direction position of the screw head of the adjustment member 145. However, a configuration is possible in which the pivoting range is restricted by providing a plate-like adjustment member 145 farther to the +Z-direction side than the tray locking hardware 160.

In the embodiment described above, the pivoter 150 is constituted by the pair of notches 121, 121 and the riser 142. However, a configuration is possible in which the pivoter 150 is constituted by one notch 121 and the riser 142. The pivoter 150 may also be formed using a hinge.

In the embodiment described above, the retainer 91 is provided in the attachment 90 that is provided in the upper housing 51*a*. However, a configuration is possible in which the retainer 91 is provided directly on the upper housing 51*a*. Additionally, the retainer 91 may be provided on the tray 53. Furthermore, a configuration is possible in which the expansion device 50 does not include the retainer 91, and the movement of the tray 53 is locked by the retaining claw abutting against the slide-railing.

In the embodiment described above, the −X-direction movement of the tray 53 is locked by the push latch 200 of the knock cam mechanism. However, a configuration is possible in which the −X-direction movement of the tray 53 is locked by the retaining claw 110 being inserted into a retainer (through-hole) 59 of the tray 53 illustrated in FIG. 7A, and being locked. In this case, the tray locker 100 does not include the push latch 200. Moreover, the tray locking mechanism 2 does not include the housing 51. In cases in which a knock cam mechanism is not used, it is preferable that the expansion device 50 include a member (for example, a contact sensor) for confirming that the tray 53 is positioned at the correct position. Additionally, the retainer 59 may be provided in a detachable attachment on the tray 53.

In the embodiment described above, the push latch 200 includes the hook 231 that engages with the engager 58 of the tray 53. However, a configuration is possible in which the push latch 200 includes two hooks that pinch the engager 58. Moreover, a configuration is possible in which the push latch 200 is a magnet latch.

In the embodiment described above, the thermally expandable sheet 10 includes the base 11, the thermally expansive layer 12, and the ink receiving layer 13. However, in the present disclosure, the structure of the thermally expandable sheet 10 is not limited thereto. For example, a configuration is possible in which the thermally expandable sheet 10 does not include the ink receiving layer 13. Additionally, a configuration is possible in which the thermally expandable sheet 10 includes a peelable release layer on the front side or the back side. The thermally expandable sheet 10 may include a layer made from another desired material.

In the embodiment described above, the terminal device 30, the printing device 40, and the expansion device 50 are independent devices. However, in the present disclosure, any two, or more, of the terminal device 30, the printing device 40, and the expansion device 50 may be integrated.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A tray locking mechanism, comprising:

a tray on which a sheet is disposed;

a moving head that processes the sheet that is disposed on the tray as the moving head moves along the sheet;

a tray locker that locks movement of the tray; and a housing that houses the tray and includes a retainer, wherein the tray locker includes a retaining claw that locks the movement of the tray by locking to the retainer, a fixer, a lever that is pushed by the moving head, and a connector that pivotably engages with the fixer and connects the retaining claw to the lever, the connector pivots with respect to the fixer, the retaining claw disengages from the retainer, as a result of the moving head pushing the lever, the lever includes a base provided perpendicular to the connector, and an abutter that includes a curved surface that extends in a direction in which the moving head pushes the lever, when the abutter is abutted against the moving head and the lever is pushed, the lever, the connector, and the retaining claw pivot in accordance with the movement of the moving head, while the moving head is positioned at a position away from a stand-by position, the retaining claw is locked to the retainer as a result of the moving head separating from the tray locker, and while the moving head is positioned at the stand-by position, the retaining claw is disengaged from the retainer as a result of the moving head pushing the tray locker.

2. The tray locking mechanism according to claim 1, wherein the retaining claw extends from one end of the connector, the lever extends from another end of the connector, and the fixer is provided below the connector.

3. The tray locking mechanism according to claim 1, wherein the fixer includes a mount on which the connector is mounted, and an auxiliary member that is attached to the mount and restricts a pivoting range of the connector.

4. The tray locking mechanism according to claim 3, wherein the connector includes a notch into which the fixer is loosely inserted, and the connector pivotably engages with the fixer as a result of the fixer being loosely inserted into the notch.

5. The tray locking mechanism according to claim 4, wherein movement of the tray is restricted as a result of the retaining claw abutting against the retainer.

6. The tray locking mechanism according to claim 1, wherein the moving head includes a pusher that pushes the lever, and the pusher contacts the abutter due to a predetermined movement of the moving head and pushes the lever in accordance with the predetermined movement of the moving head, thereby causing the lever, the connector, and the retaining claw to pivot.

7. The tray locking mechanism according to claim 6, wherein the predetermined movement of the moving head is a movement of the moving head to the stand-by position from a position separated from the stand-by position, and due to the predetermined movement of the moving head, the pusher pushes the lever, causing the lever, the connector, and the retaining claw to pivot, separating the retaining claw from the retainer, thereby allowing the tray to move.

8. The tray locking mechanism according to claim 7, wherein the pusher is detachable from the moving head.

9. A tray locking mechanism, comprising:

a tray on which a sheet is disposed;

a moving head that processes the sheet that is disposed on the tray as the moving head moves along the sheet;

a tray locker that locks movement of the tray; and a housing that houses the tray and includes a retainer, wherein the tray locker includes a latch that includes a knock cam mechanism, and a retaining claw that locks the movement of the tray by locking to the retainer, the tray includes an engager that engages with the latch, while the tray is positioned at a predetermined position of the housing and the moving head is separated from the stand-by position, the engager is engaged with the latch, and while the tray is positioned at the predetermined position of the housing and the moving head is positioned at the stand-by position, engagement between the engager and the latch is released as a result of the tray being moved in a predetermined direction, while the moving head is positioned at a position away from a stand-by position, the retaining claw is locked to the retainer as a result of the moving head separating from the tray locker, and while the moving head is positioned at the stand-by position, the retaining claw is disengaged from the retainer as a result of the moving head pushing the tray locker.

10. The tray locking mechanism according to claim 9, wherein the tray locker further includes an elastic member that energizes the retaining claw, and while the moving head is separated from the stand-by position, the retaining claw locks to the retainer due to energizing force of the elastic member.

11. The tray locking mechanism according to claim 10, wherein the retainer is provided on a detachable attachment.

12. The tray locking mechanism according to claim 9, which, in operation, couples to an expansion device, wherein the sheet is a thermally expandable sheet, and the moving head irradiates the thermally expandable sheet with electromagnetic waves, thereby causing the thermally expandable sheet to distend.

13. The tray locking mechanism according to claim 12, wherein the expansion device is part of a shaping system that includes a printing device that prints a conversion layer on the thermally expandable sheet, the conversion layer converting electromagnetic waves to heat; wherein the moving head, in operation, irradiates the thermally expandable sheet, on which the conversion layer is printed by the printing device, with electromagnetic waves while the expansion device moves the moving head, causing the thermally expandable sheet to distend.

14. A tray locking mechanism, comprising:

a tray on which a sheet is disposed;

a moving head that processes the sheet that is disposed on the tray as the moving head moves along the sheet, a tray locker that locks movement of the tray; and a housing that houses the tray, wherein the tray locker includes a retaining claw that locks the movement of the tray by locking to a retainer provided on the tray, and a latch that includes a knock cam mechanism, the tray includes an engager that engages with the latch, while the tray is positioned at a predetermined position of the housing and the moving head is separated from the stand-by position, the engager is engaged with the latch, while the tray is positioned at the predetermined position of the housing and the moving head is positioned at the stand-by position, engagement between the engager and the latch is released as a result of the tray being moved in a predetermined direction, while the moving head is positioned at a position away from a stand-by position, the retaining claw is locked to the retainer as a result of the moving head separating from the tray locker, and while the moving head is positioned at the stand-by position, the retaining claw is disengaged from the retainer as a result of the moving head pushing the tray locker.

15. The tray locking mechanism according to claim 14, which, in operation, couples to an expansion device; wherein the sheet is a thermally expandable sheet, and the moving head irradiates the thermally expandable sheet with electromagnetic waves, thereby causing the thermally expandable sheet to distend.

16. The tray locking mechanism according to claim 15, wherein the expansion device is part of a shaping system that includes a printing device that prints a conversion layer on the thermally expandable sheet, the conversion layer converting electromagnetic waves to heat, wherein the moving head, in operation, irradiates the thermally expandable sheet, on which the conversion layer is printed by the printing device, with electromagnetic waves while the expansion device moves the moving head, causing the thermally expandable sheet to distend.

17. A tray locking mechanism, comprising:

a tray on which a sheet is disposed;

a moving irradiation head that irradiates the sheet that is disposed on the tray with electromagnetic waves while moving along the sheet;

a tray locker that locks movement of the tray; and a housing that houses the tray and includes a retainer, wherein the tray locker includes a retaining claw that locks the movement of the tray by locking to the retainer, while the moving irradiation head is positioned at a position away from a stand-by position, the retaining claw is locked to the retainer as a result of the moving irradiation head separating from the tray locker, and while the moving irradiation head is positioned at the stand-by position, the retaining claw is disengaged from the retainer as a result of the moving irradiation head pushing the tray locker.

* * * * *